US012416148B1

(12) United States Patent
Lopez-Perez

(10) Patent No.: US 12,416,148 B1
(45) Date of Patent: Sep. 16, 2025

(54) CONSTRUCTING A BUILDING USING PRE-FABRICATED MATERIALS SHAPED FROM TRUNCATED POLYHEDRONS

(71) Applicant: Daniel Lopez-Perez, San Diego, CA (US)

(72) Inventor: Daniel Lopez-Perez, San Diego, CA (US)

(73) Assignee: Daniel Lopez-Perez, La Jolla, CA (US)

( * ) Notice: Subject to any disclaimer, the term of this patent is extended or adjusted under 35 U.S.C. 154(b) by 416 days.

(21) Appl. No.: 17/472,519

(22) Filed: Sep. 10, 2021

Related U.S. Application Data

(60) Provisional application No. 63/077,519, filed on Sep. 11, 2020.

(51) Int. Cl.
*E04B 1/10* (2006.01)
*E02D 27/50* (2006.01)
(Continued)

(52) U.S. Cl.
CPC ..... *E04B 1/10* (2013.01); *E02D 27/50* (2013.01); *E04B 1/0007* (2013.01); *E04B 7/026* (2013.01);
(Continued)

(58) Field of Classification Search
CPC ..... E04B 1/10; E04B 1/0007; E04B 7/026; E04B 2001/0092; E04B 2103/04; E02D 27/50; E04F 15/04
See application file for complete search history.

(56) References Cited

U.S. PATENT DOCUMENTS 3,974,600 A * 8/1976 Pearce ..... E04B 1/32 D25/4
4,136,988 A * 1/1979 Nist ..... A47C 19/021 403/231
(Continued)

FOREIGN PATENT DOCUMENTS

WO 2019038569 A1 2/2019

OTHER PUBLICATIONS

Cross Laminated Timber Examples 1 Accessed at: https://info.thinkwood.com/clt-handbook.
(Continued)

*Primary Examiner* — Phi D A
(74) *Attorney, Agent, or Firm* — Perkins Coie LLP

(57) ABSTRACT

The disclosed technology can be implemented to use pre-fabricated materials shaped from truncated polyhedrons to construct customized building designs via on-site assembling without otherwise complex, expensive, and laborious on-site construction. In implementations, such pre-fabricated materials can be made as components for a customized building design and can be fabricated from strong, durable fabricated materials such as composite wood materials like cross laminated timber ("CLT") materials and others suitable for mass production and customization. In addition, the disclosed technology can be implemented to provide a home design and construction service online platform to enable customers to plan and to do customized designs for, their business buildings or homes at their selected sites, to order the construction of their buildings based on their final designs and to monitor the construction process, and to engage building material suppliers and construction contractors in the building design, planning and construction processes.

24 Claims, 30 Drawing Sheets

(51) Int. Cl.
*E04B 1/00* (2006.01)
*E04B 7/02* (2006.01)
*E04F 15/04* (2006.01)

(52) U.S. Cl.
CPC ..... *E04F 15/04* (2013.01); *E04B 2001/0092* (2013.01); *E04B 2103/04* (2013.01)

(56) References Cited

U.S. PATENT DOCUMENTS 4,621,467 A * 11/1986 Golden ..... E04B 1/3211 D25/13
4,663,898 A * 5/1987 Yacaboni ..... E02D 27/42 D25/19
4,729,197 A * 3/1988 Miller ..... E04B 1/3211 52/81.3
5,315,806 A * 5/1994 Da Casta Trias de Bes ..... B28B 7/00 52/654.1
5,924,905 A * 7/1999 Cyrus ..... G09B 25/04 434/152
6,173,538 B1 * 1/2001 Fleishman ..... E04B 1/34815 52/81.3
6,253,520 B1 * 7/2001 Houk ..... E04B 1/08 52/646
6,282,849 B1 * 9/2001 Tuczek ..... E04B 1/32 52/648.1
6,658,800 B2 12/2003 Monson et al.
8,701,357 B2 * 4/2014 Kovel ..... E04B 1/00 52/236.4
2001/0020352 A1 * 9/2001 Pries ..... E04H 1/02 52/745.19
2003/0046895 A1 * 3/2003 Haffner ..... B32B 3/08 52/800.1
2007/0251161 A1 * 11/2007 Tuczek ..... E04B 7/102 52/80.1
2007/0256370 A1 * 11/2007 Whittingham ..... E04B 1/3211 52/81.1
2012/0304549 A1 * 12/2012 Rutledge ..... E04B 7/028 52/302.1
2020/0071924 A1 * 3/2020 Di Marino ..... E04B 1/0007
2020/0181905 A1 * 6/2020 Jarck ..... E04C 2/46

OTHER PUBLICATIONS

Ground Screw Systems, ICC-ES Evaluation Report, ESR-4226, 2020.
American Ground Screw, MFG & Supply. Accessed at: https://www.americangroundscrew.com/.
California Building Standards Code, Building Standards Commission. Accessed at: https://www.dgs.ca.gov/BSC/Codes.
Karacabeyli, et al., CLT Handbook, Cross-Laminated Timber, 2013. Accessed at: https://cdn2.hubspot.net/hubfs/5577290/PDFs/CLT%20Handbook/CLT_USA-Complete-document-Think_Wood.pdf.
Weisstein, Eric W. "Archimedean Solid." From MathWorld—A Wolfram Web Resource. https://mathworld.wolfram.com/ArchimedeanSolid.html.
Weisstein, Eric W. "Semiregular Polyhedron." From MathWorld—A Wolfram Web Resource. https://mathworld.wolfram.com/SemiregularPolyhedron.html.
Weisstein, Eric W. "Truncation." From MathWorld—A Wolfram Web Resource. https://mathworld.wolfram.com/Truncation.html.
Digiammo, A., "Designing with Polygons." CoastalContractor, Summer 2005, 2 pages.
Mercolini, N. et al., "Form Follows Fun: Design Options in Modern Ceiling and Wall Systems." Continuing Education Center, Dec. 2014, 19 pages.
Ock, J.H., "Testing as-Built Quality of Free-Form Panels: Lessons Learned from a Case Study and Mock-up Panel Tests." Applied Sciences, 2021, 11, 1439, 21 pages.

* cited by examiner

Perspective View

Top View

Sequence of wall and roof assembly: step 3

Sequence of wall and roof assembly: step 4

Top View

Perspective View

CONSTRUCTING A BUILDING USING PRE-FABRICATED MATERIALS SHAPED FROM TRUNCATED POLYHEDRONS

PRIORITY CLAIM AND CROSS REFERENCE TO RELATED APPLICATION

This patent document claims priority to and benefits of U.S. Patent Application No. 63/077,519 entitled "CONSTRUCTING A BUILDING USING PRE-FABRICATED MATERIALS SHAPED FROM TRUNCATED POLYHEDRONS" and filed on Sep. 11, 2020. The entire content of the before-mentioned patent application is incorporated by reference as part of the disclosure of this patent document.

TECHNICAL FIELD

This patent document relates to designs, structures and materials of a building or sheltered structure suitable for use as business space or dwelling space and related processes of constructing such a building or sheltered structure.

BACKGROUND

Homes and business buildings may be constructed or built on site by building a foundation and constructing other parts piece by piece over the foundation by using various building materials such as cement, concrete materials, bricks, stones, wood materials, metal materials or others. Some building materials may be cut and shaped on site while other building materials may be pre-fabricated off site such as bricks. An alternative to such on-site construction is assembling pre-fabricated homes by delivering off-site pre-fabricated building components to a home site and assembling pre-fabricated building components at the site to complete the construction without the on-site construction. A significant part of such pre-fabricated homes on the market tends to be inexpensive homes with pre-determined simple structures and designs such as mobile homes or trailer homes.

SUMMARY

The technology for designing and constructing homes and business buildings or structures disclosed in this patent document is based in part on the recognition of limitations of various existing on-site building construction processes and pre-fabricated home methods and in part based on the recognition of the needs for providing an efficient and scalable way of building high quality, versatile, custom designed business buildings and homes that are tailored to specific building sites and have unique and customized designs which are generally not available to the mass building construction market, especially the general residential home market.

In one aspect, the disclosed technology can be implemented to use pre-fabricated building materials shaped from truncated polyhedrons to construct customized building designs via on-site assembling without otherwise complex, expensive, and laborious on-site construction. In implementations, such pre-fabricated building materials shaped from truncated polyhedrons can be made as components for a customized building design and can be fabricated from strong, durable fabricated materials such as composite wood materials like cross laminated timber ("CLT") materials and others suitable for mass production and customization. Using specially edged or hinge engagement mechanisms and various suitable engagement mechanisms, pre-fabricated building materials shaped from truncated polyhedrons for a customized building design can be assembled at a building site to form main structures of the customized building in the form of a network of interconnected facets of varying sizes in a mathematical pattern derived from truncation. Fabrication of pre-fabricated building materials as components for a customized building design can include cutting blanks of pre-fabricated building materials into suitable flat components in selected truncated polyhedronal facet shapes from truncated polyhedral solids with desired sizes for the customized building design.

In another aspect, the disclosed technology can be implemented to provide a home design and construction service online platform to enable customers to plan and to do customized designs for, their business buildings or homes at their selected sites, to order the construction of their buildings based on their final designs and to monitor the construction process.

In yet another aspect, the disclosed technology enables the home design and construction service online platform to provide a building material supply platform to enable building material supply companies to bid for supplying part of or the entirety of pre-fabricated building materials and other materials for a particular customer building service of a customer and subsequently deliver the pre-fabricated building materials and other materials to the customer building site for assembling.

In yet another aspect, the disclosed technology can further enable the home design and construction service online platform to provide a construction labor exchange platform to enable construction companies, individual construction workers and technicians to bid for performing the customer-ordered building construction.

Examples of those and other aspects, features and their implementations of the disclosed technology are described in greater detail in the drawings, the description and the claims.

DETAILED DESCRIPTION

Figure 1A:
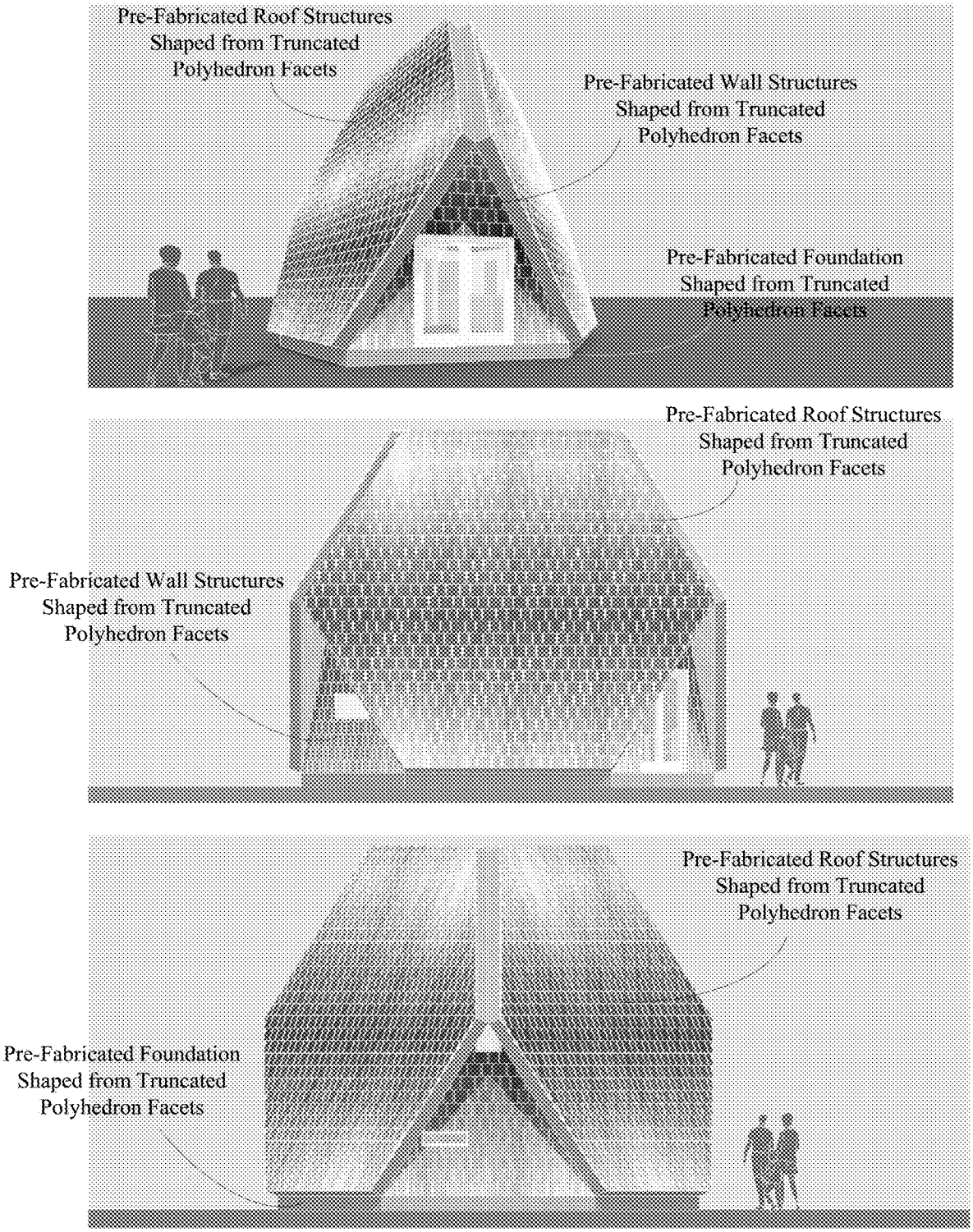
FIGS. 1A through 1D illustrate an example of a home design based on pre-fabricated building materials shaped from truncated polyhedrons and examples of interior and exterior features.

Building construction for unique customized designs traditionally require individual designs to meet specific customer needs and customer tailored materials and construction processes that vary from one project to another. Such traditional building construction for unique customized designs are difficult to be scaled up to reduce the costs of the materials, the costs of the construction and the overall cost of the buildings. Accordingly, unique customized designs have not been available for general building construction in a large scale. This is especially true for residential home market where the steadily increasing demand for more residential homes drives the entire home market into large scales of identical or substantially similar residential designs and use of large quantities of identical or substantially similar materials and components in large residential development projects in order to gain the economic scaling advantage to reduce the costs of the designs, building materials, construction and regulatory compliance, thus rendering the home price affordable to large populations of home buyers. It is a well-accepted conventional wisdom and perception in the home construction industry that unique customized designs are not suitable for large home construction projects and are only available for individual construction projects for business buildings and certain exclusive and expensive home projects. This conventional perception on unique customized designs is consistent with, and is supported by, the cost structure of business buildings and homes based on various well established building design methods, available commercial building materials and well established construction methods.

The technology disclosed in this patent document provides a different building design and construction paradigm that adopts new design methods for scalable uniquely customized designs, uses new building material configurations and new building materials and implements new construction methods based on on-site assembling of pre-fabricated components produced in large scale production with no or minimized on-site construction processes to render uniquely customized designs scalable to a mass market (mass-customization). In particular, the technology disclosed in this patent document implements scalable features and cost-reduction features at multiple key stages and cycles of the building design phase, the planning phase of the construction, the construction phase, the quality control over the entire process, and the sale of the constructed buildings to buyers to achieve significant overall cost savings that are not achievable or are difficult to achieve by using various well established building design methods, available commercial building materials and well established construction methods. Those and other features in the disclosed technology are based in part on the recognition of limitations of various existing on-site building construction processes and pre-fabricated home methods and in part based on the recognition of the needs for providing an efficient and scalable way of building high quality, versatile, custom designed business buildings and homes that are tailored to specific building sites and have unique and customized designs which are generally not available to the mass building construction market, especially the general residential home market.

On the building designs, use of building materials and construction of the building, the disclosed technology employs pre-fabricated building materials shaped from truncated polyhedrons to construct customized building designs via on-site assembling without otherwise complex, expensive, and laborious on-site construction. Such pre-fabricated building panels are shaped from polygonal facets of truncated polyhedrons, and, notably, when connected with one another to form floor, wall and roof structures as the core structure of a building, the total assembly of such pre-fabricated building panels takes on the geometry or shape of a corresponding truncated polyhedron which is known to be structurally rigid, strong and stable due to its regularity. The polygonal shapes of the pre-fabricated building panels are regular or symmetrical shapes that are suitable for mass production in scale with high precision by robotic fabrication tools or machines. Significantly, a variety of composite material structures can be used to such pre-fabricated building panels in polygonal shapes that demonstrate superior structural strength, durability, manufacturability, and reduced cost at large scales. Examples of suitable composite materials include composite wood materials like cross laminated timber ("CLT") materials and others suitable for mass production and customization and may also be made from non-wood composite materials. Using specially edged or hinge engagement mechanisms and various suitable engagement mechanisms, pre-fabricated building materials shaped from facets of truncated polyhedrons can be assembled at a building site to form main structures of the customized building in the form of a network of interconnected facets of varying sizes in a mathematical pattern derived from truncation. Examples of suitable geometrical polyhedral solids based on such truncation include 8-facet tetrahedrons with 4 triangular facets and 4 hexagonal facets, 9-facet octahedrons with 4 hexagonal facets, 4 triangular facets and 1 octagonal facet, and 14-facet cubes with 8 triangular facets and 6 octagonal facets) result in a regular network of facets. Fabrication of pre-fabricated building materials as components for a customized building design can include cutting blanks of pre-fabricated building materials into suitable flat components in selected polyhedronal facet shapes from truncated polyhedral solids with desired sizes for building structures in the customized building design, e.g., floors, walls, roofs and others.

Deviating from identical, nearly identical or substantially similar designs of different homes in the same residential project constructed using conventional design and construction methods, the disclosed use of flat panel components in selected polyhedronal facet shapes from truncated polyhedral solids can generate visually dramatic and structurally different building architectural features while using seemingly similar flat panel components in polyhedronal facet shapes made from a large scale and automated production process by choosing certain desired truncated polyhedral solids at the design phase. The regularity in various repeated facet patterns of truncated polyhedral solids allows computer-driven modeling and designing processes to be highly suitable for designing different structures and appearances that are complex in their appearances and structures based on well-developed and precise mathematical processes and topological configurations via digital processing. However, such structures and appearances that are complex in their appearances and structures are made of simple flat panel components in polyhedronal facet shapes that are made by computer driven automated machines at large commercial fabrication companies, are constructed by mechanically precise and highly stable truncated polyhedral structures and can be assembled together in simple, reliable and secure engagement mechanisms by using either or both built-in engagement features in such panels and separate engagement components and fasteners. The shortcomings and disadvantages in traditional on-site construction can be largely eliminated or significantly reduced, such as on-site cutting raw materials, making reinforced concrete slabs and structures, building a structure in a piece by piece process, the high labor cost due to labor intensive process and requirements of skilled construction technicians, the slow construction process due to the on-site preparation and building the structures in a building, and susceptibility to human errors in construction and associated defects in the built structures, and low utilization of raw building materials in the final constructed building. Due to the unique use of the flat panel components in polyhedronal facet shapes and other innovations in the disclosed technology, the advantages of high quality and low cost building materials from scalable mass production can be used to assembling customized building designs to produce reasonably priced customized buildings.

The disclosed technology for assembling buildings with unique customized designs includes a computer-driven design and construction service platform that integrates the sales of the customer requested buildings (offices or homes) as part of the design process before beginning of the allocating financial and human resources for the building materials and for the construction. This aspect of the technology enables a building to be sold prior to construction of the building, a completely different process from the sales of buildings and homes in the conventional way. This computer-driven design and construction service platform directly addresses special needs of each individual customer and enables the customer to make an early decision for purchasing the building and bearing the cost of the construction by providing benefits to both customers and the service provider. In this regard, the disclosed technology can be implemented to provide a home design and construction service online platform to enable customers to plan and to do customized designs for, their business buildings or homes at their selected sites, to order the construction of their buildings based on their final designs and to monitor the construction process.

In addition, the disclosed technology enables the home design and construction service online platform to further integrate other parties in the construction process, including suppliers for building materials and components and construction contractors (e.g., construction companies and individual construction technicians and workers) to efficiently integrate those parties as integral part of the building design and construction process to enable smooth commercial transactions. For example, the home design and construction service online platform can be designed to provide a building material supply platform to enable building material supply companies to bid for supplying part of or the entirety of pre-fabricated building materials and other materials for a particular customer building service of a customer and subsequently deliver the pre-fabricated building materials and other materials to the customer building site for assembling. For another example, the home design and construction service online platform can be designed to provide a construction labor exchange platform to enable construction companies, individual construction workers and technicians to bid for performing the customer-ordered building construction. Therefore, the requirements of a customer on a customer-selected building at a particular location, the needs for purchasing all building materials and pre-fabricated components or parts and the needs for construction contractors for on-site assembling can be integrated to ensure the fulfillment of all requirements and to reduce the risks among all the participating parties and to provide better building designs and products to customers while providing opportunities and the flexibilities to material suppliers and construction contractors.

FIG. 1A shows three different exterior views of an example of a customized building design for a residential home via on-site assembling of pre-fabricated flat panel components in polyhedronal facet shapes to form hexagon shaped foundation frame and floor and hexagon shaped roof structures. The house is formed on a foundation assembled by pre-fabricated components, walls that are assembled by pre-fabricated polygonal flat panels and roofs that are assembled by pre-fabricated polygonal flat panels. The foundation is anchored to the home site by suitable anchoring mechanism such as ground screws and other components are mounted and fixed onto the foundation. As illustrated, doors, windows and other openings can be formed by the pre-fabricated panels.

Figure 1B:
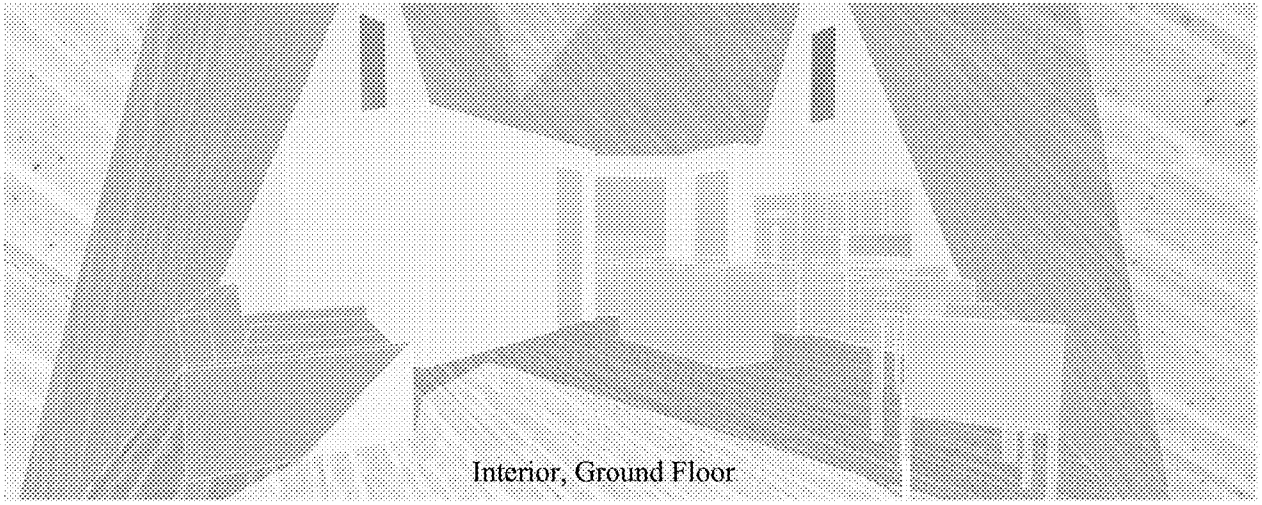
Figure 1B:
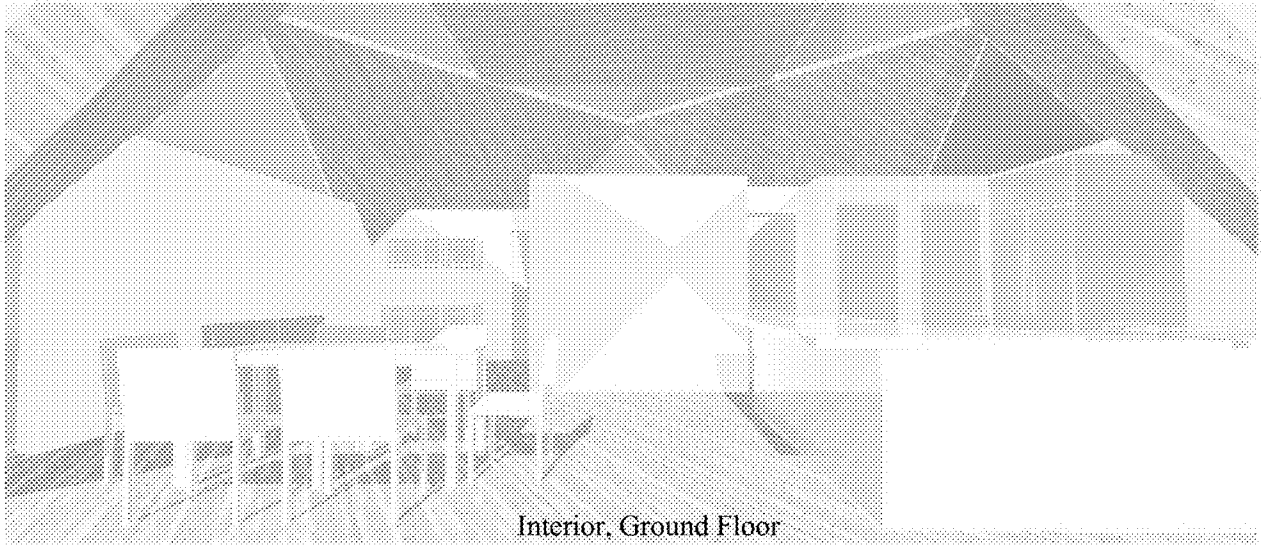
Figure 1C:
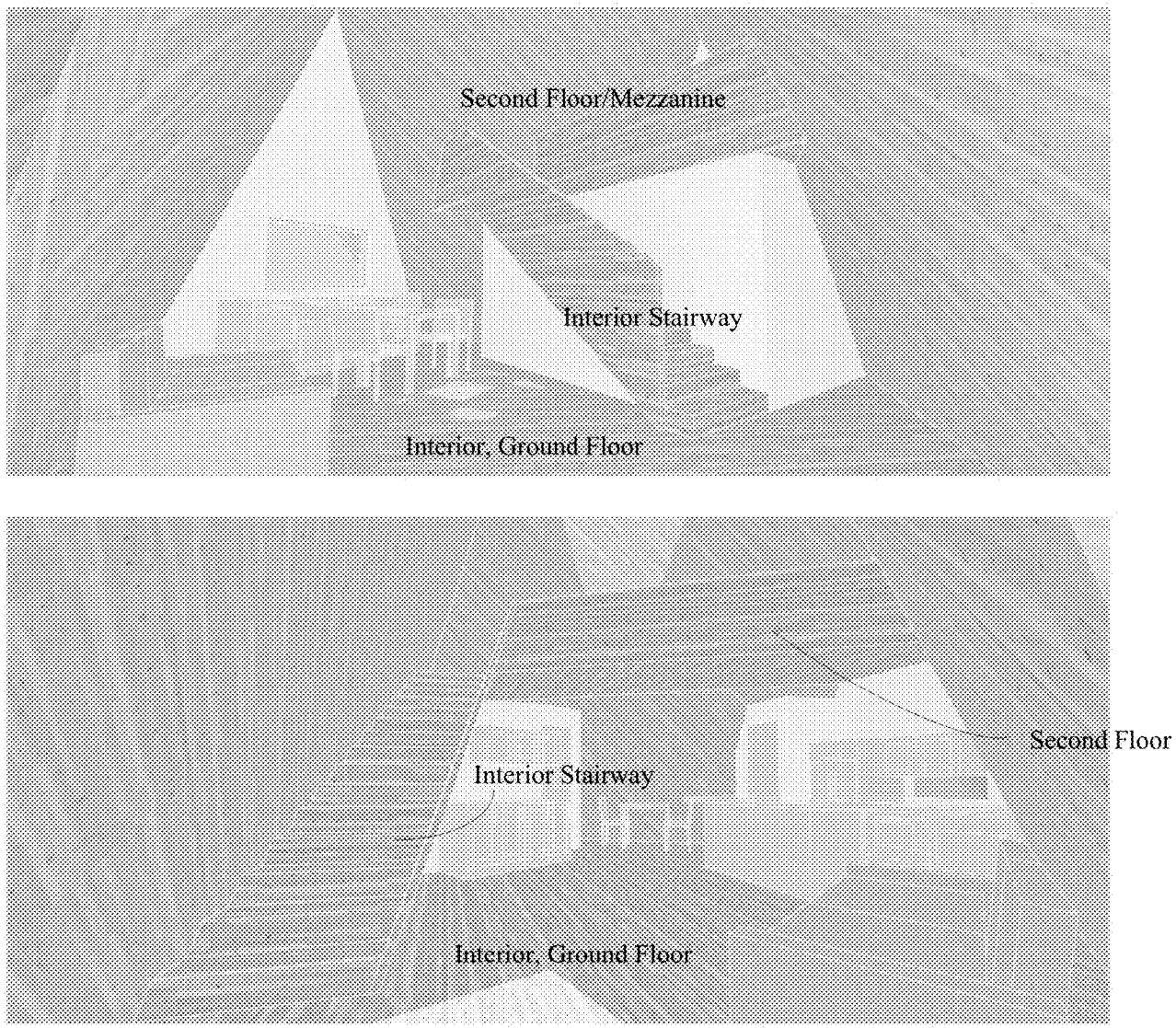
Figure 1D:
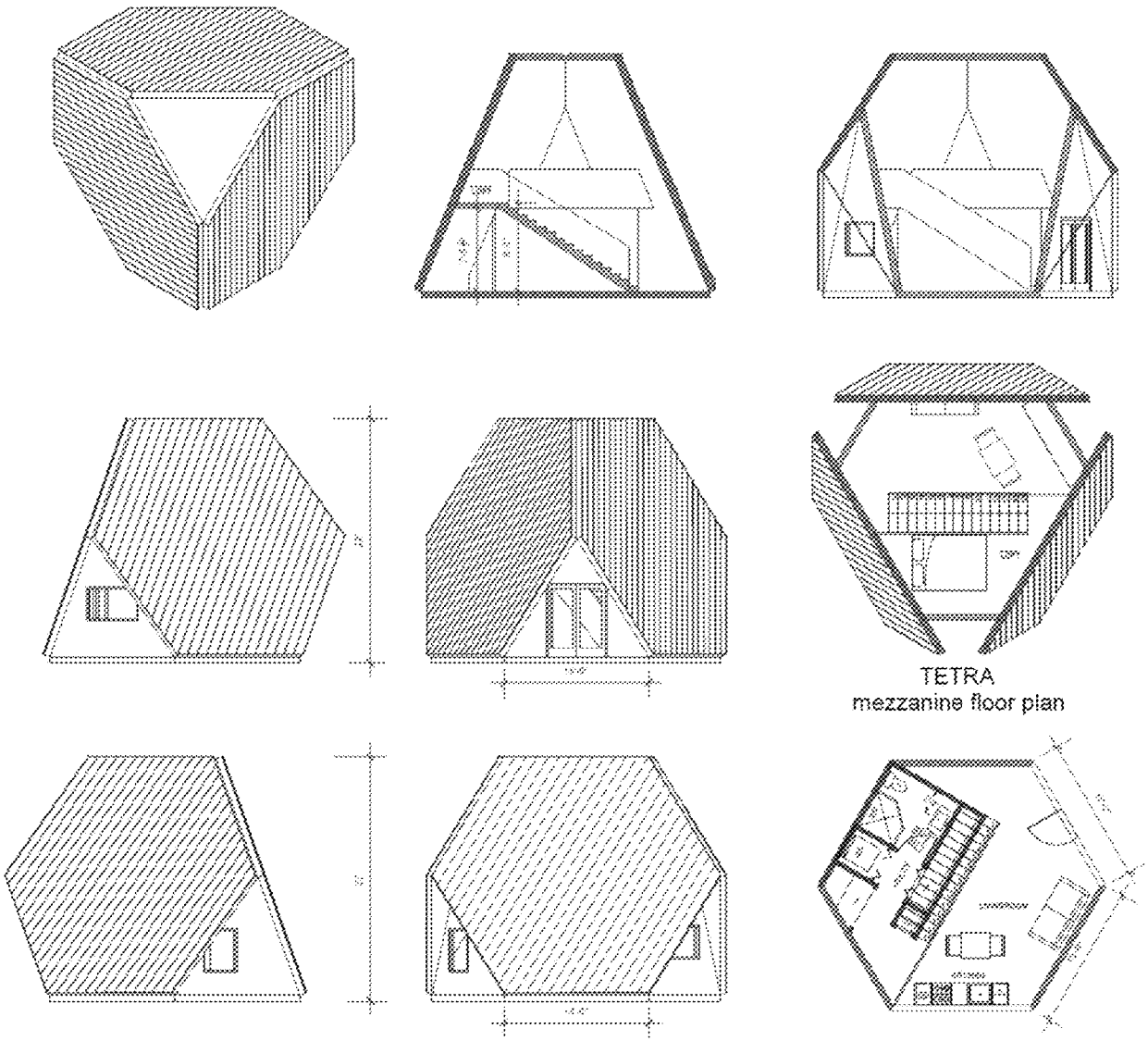

FIGS. 1B and 1C shows examples of interior designs of the home in FIG. 1A. Similar to the dramatic customized external architectural features due to the hexagon shapes, the interior space is also designed to have a dramatic appearance based on the sloped roof lines. FIG. 1C shows an interior stairway leading to a second floor or a mezzanine above the ground floor inside the house. FIG. 1D shows different views of an example plan for the house in FIG. 1A showing additional details of various exterior and internal structures.

Various materials can be used to make pre-fabricated flat panel components in polyhedronal facet shapes including man-made composite materials, synthetic materials and natural materials. One category of composite materials produced by industrial fabrication is composite materials based on natural wood raw materials such as laminated panels, bars or pillars. Such a composite wood material includes different wood pieces that are laminated and pressed together, resulting a stronger and more durable structure than the original wood pieces and can be shaped into different sizes and geometries. One example is a commercial material cross laminated timber ("CLT") panels formed by laminating the different wood pieces that are oriented in different directions such as orthogonal directions.

Figure 2:
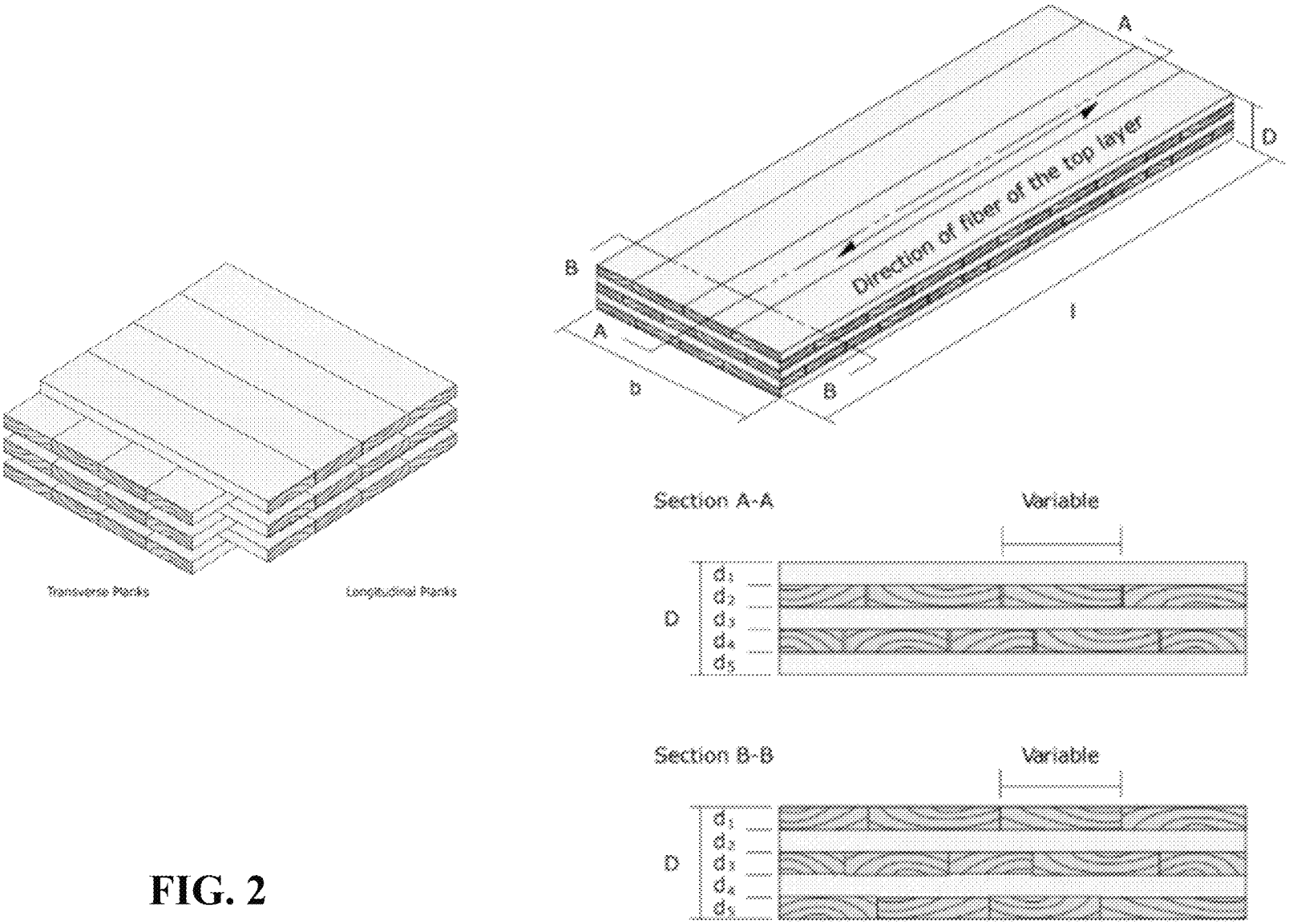
FIGS. 2 and 3 show examples of pre-fabricated building materials shaped from truncated polyhedrons.

FIG. 2 shows an example of a CLT panel in different views. In some CTL panel constructions, the thickness of individual lumber pieces may vary from ⅝ inch to 2.0 inches (16 mm to 51 mm) and the width may vary from about 2.4 inches to 9.5 inches (60 mm to 240 mm). Boards are finger jointed using structural adhesive. Lumber is visually graded or machine stress rated and is kiln dried. Panel sizes vary by manufacturer; typical widths are 2 ft. (0.6 m), 4 ft. (1.2 m), 8 ft. (2.4 m) and 10 ft. (3 m) while length can be up to 60 ft. (18 m) and the thickness can be up to 20 inches (508 mm). Lumber in the outer layers of CLT panels used as walls are normally oriented up and down, parallel to gravity loads, to maximize the wall's vertical load capacity. Likewise, for floor and roof systems, the outer layers run parallel to the major span direction. Additional information on examples of CLT panels can be found in Appendix 1 entitled "Cross Laminated Timber ("CLT") Examples" of the filed U.S. Patent Application No. 63/077,519 which includes example designs of engagement mechanisms for engaging CLT panels in building construction. Also see "CLT Handbook: Cross Laminated Timber" edited by Erol Karacbeyll and Brad Douglass (2013 U.S. Edition) at the following website: https://cdn2.hubspot.net/hubfs/5577290/PDFs/CLT % 20-Handbook/CLT USA-Complete-document-Think_Wood.pdf.

Figure 3:
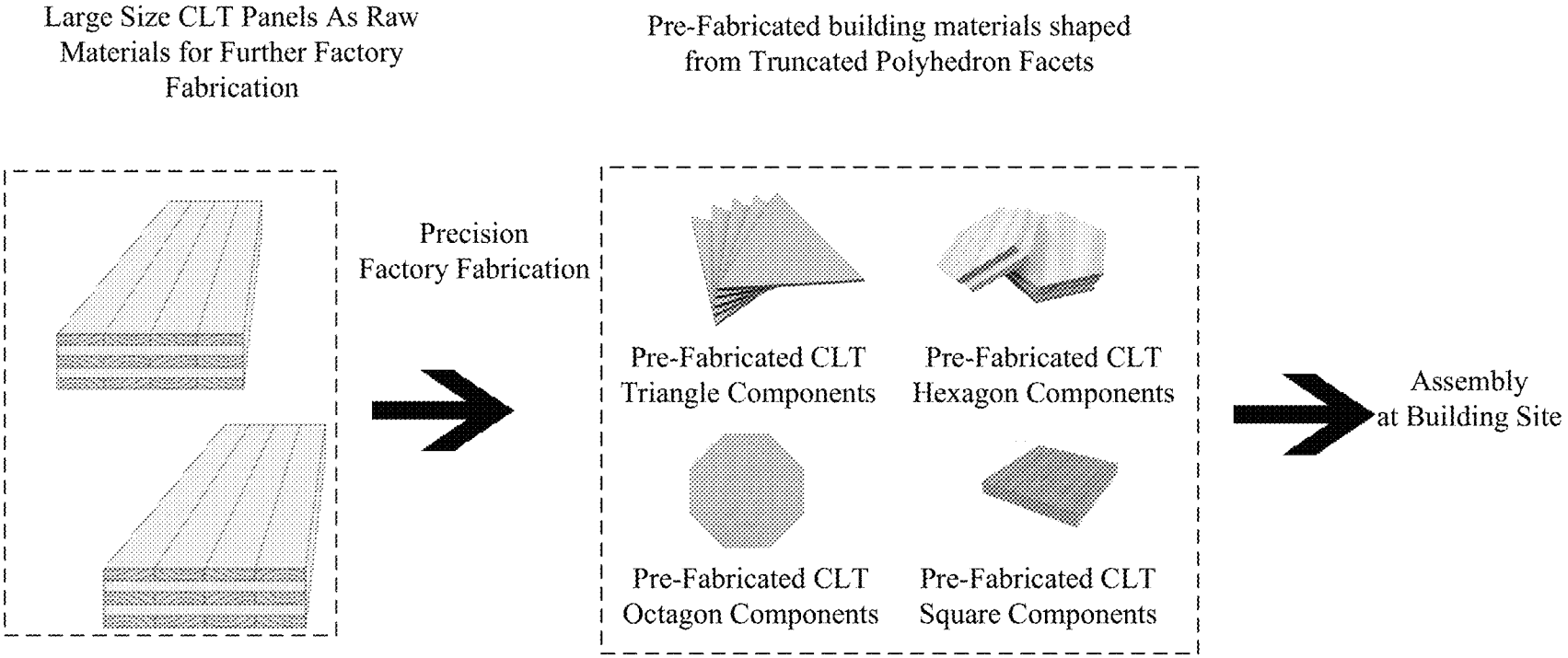

FIG. 3 shows that large CLT panels can be cut in the CLT manufacturing process into smaller pre-fabricated flat panel components in polyhedronal facet shapes by using computer-controlled precision cutting machines. Examples of triangle CLT panels, hexagon CLT panels, Octagon CLT panels and square CLT panels are shown. Those pre-cut and pre-fabricated CLT panels in polyhedronal facet shapes in varying sizes are used to form part of complete packages of materials for different customized homes and office buildings and are shipped to construction sites for on-site assembling.

Figure 4:
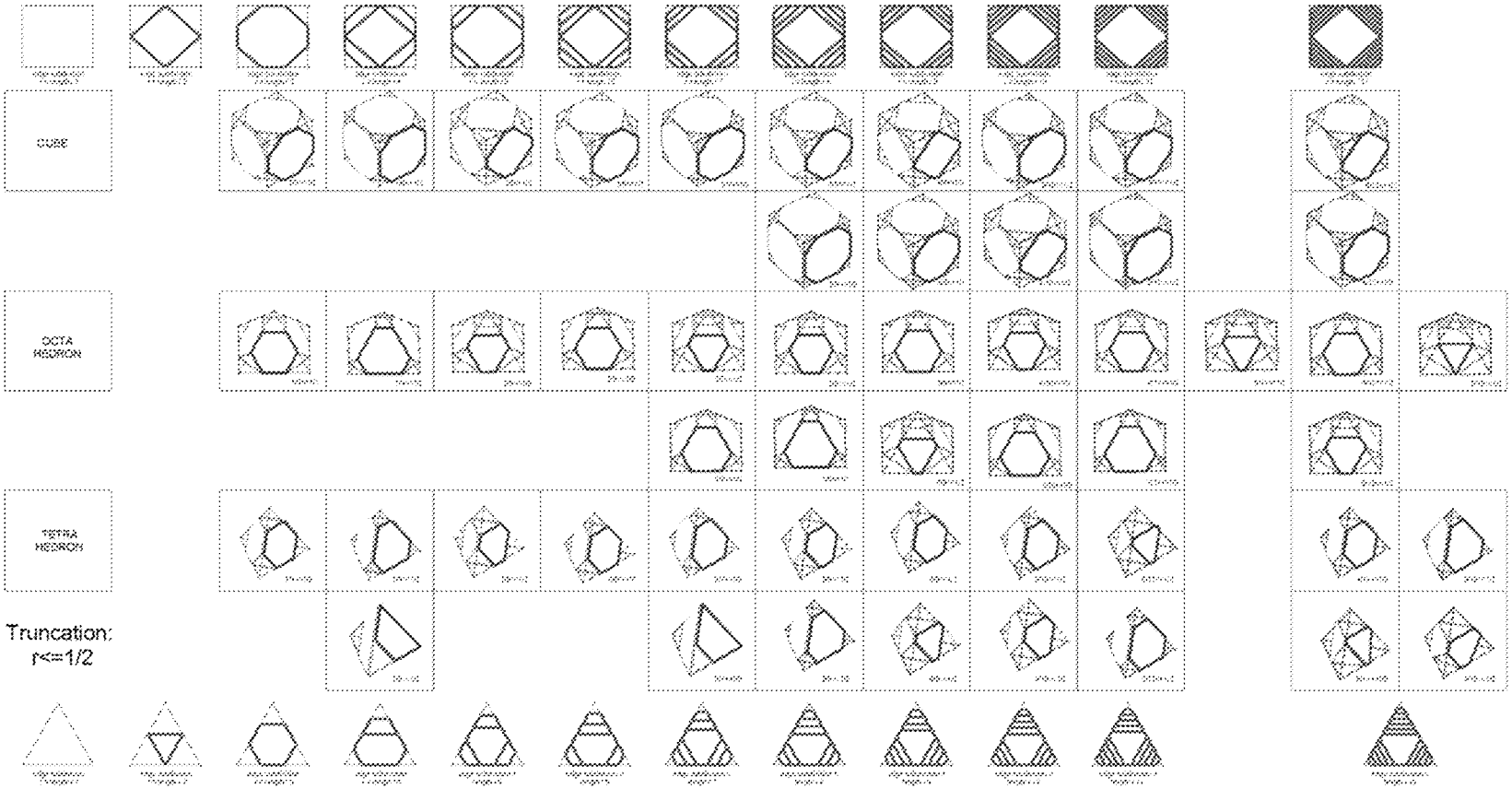
FIGS. 4, 5 and 6 show examples of truncation of polyhedrons to generate pre-fabricated building panels with polygonal facets of truncated polyhedrons.

FIG. 4 shows examples of selected polyhedral truncation examples that may be used in implementing the disclosed technology. Polyhedral truncation is the removal of portions of polyhedral solids falling outside a set of symmetrically placed faces. The operation of Polyhedral Truncation displaces points along the edges of a polyhedron's face by a ratio r<=½ where r is the fraction of the edge length at which to truncate. Specific examples of variations of truncation based on result from the mathematical process of polyhedral truncation. In this process, a series of polyhedral primitives that include a tetrahedron, half of an octahedron, or a cube (amongst many others), are truncated from the subdivision of their edges. In this process, each of the polyhedral edges for each solid is firstly subdivided evenly in increasingly higher ratios: ½, ⅓, ¼, ⅕, etc., This rate of subdivision of the polyhedral edges results in a series of points from which to determine the degree of truncation for each polyhedral solid. The limit of truncation for each of the polyhedral edges is r<=½; or in other words, the center-point of each of its edges. Some information on truncation can be found at a truncation tutorial material at the link: https://mathworld.wolfram.com/Truncation.html. Semiregular polyhedrons are those whose faces are all regular polygons and their corners are alike. https://mathworld.wolfram.com/SemiregularPolyhedron.html. Archimedean Solids are the 13 convex polyhedra that have a similar arrangement of non-intersecting regular convex polygons of two or more different types arranged in the same way about each vertex with all sides the same length. https://mathworld.wolfram.com/ArchimedeanSolid.html. For example, a truncated tetrahedron is a semiregular 8-face polyhedron made of 4-triangular faces and 4-hexagonal faces: 4 {3}+4 {6}. A truncated octahedron is a semiregular 9-face Polyhedron made of 4-hexagonal faces, 4-triangular faces and 1-octagonal face: 4 {6}+4 {3}+1 {8}. A truncated cube is a semiregular 14-face polyhedron made of 8-triangular faces and 6-octagonal faces: 8 {3}+6 {8}.

Figure 5:
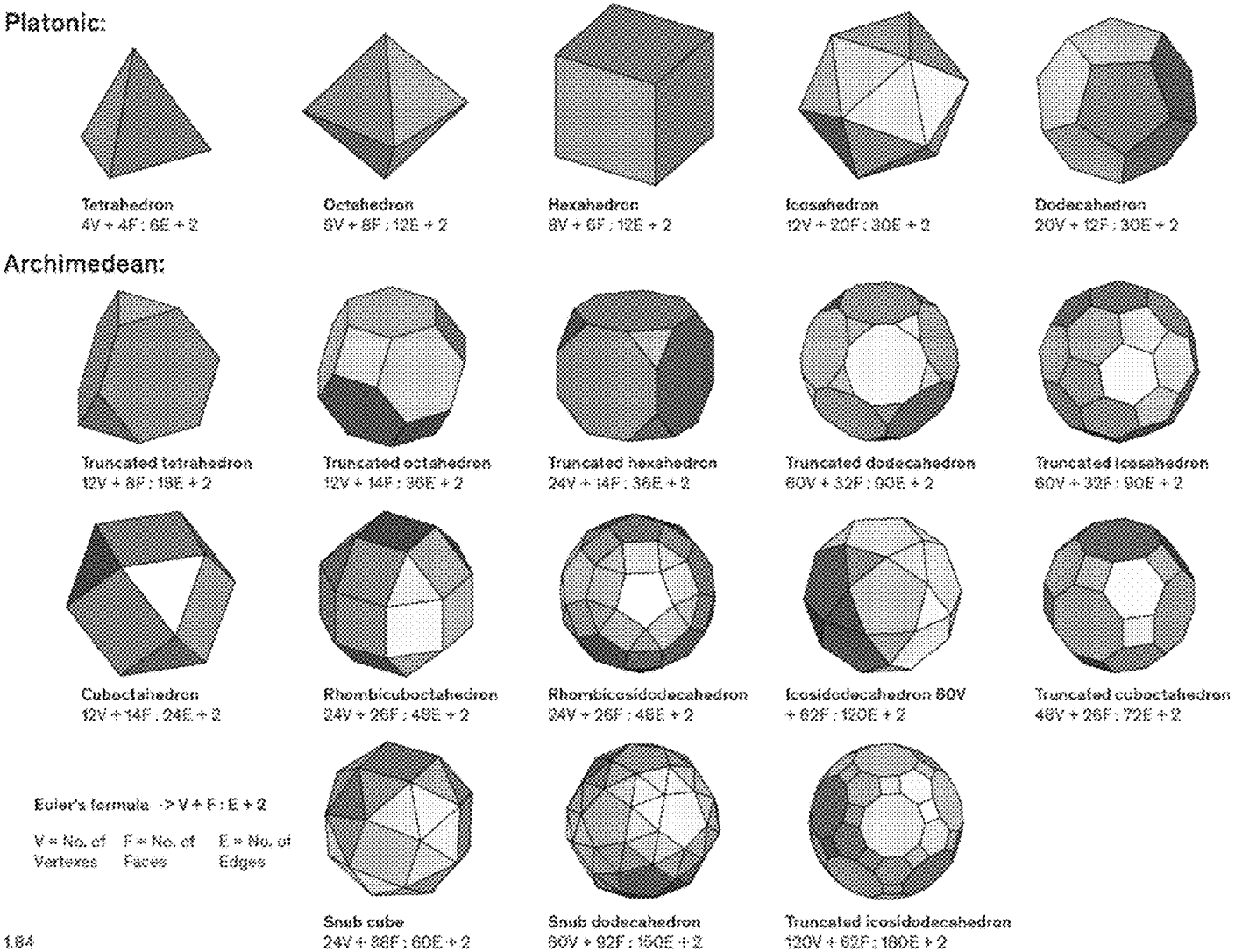
Figure 6:
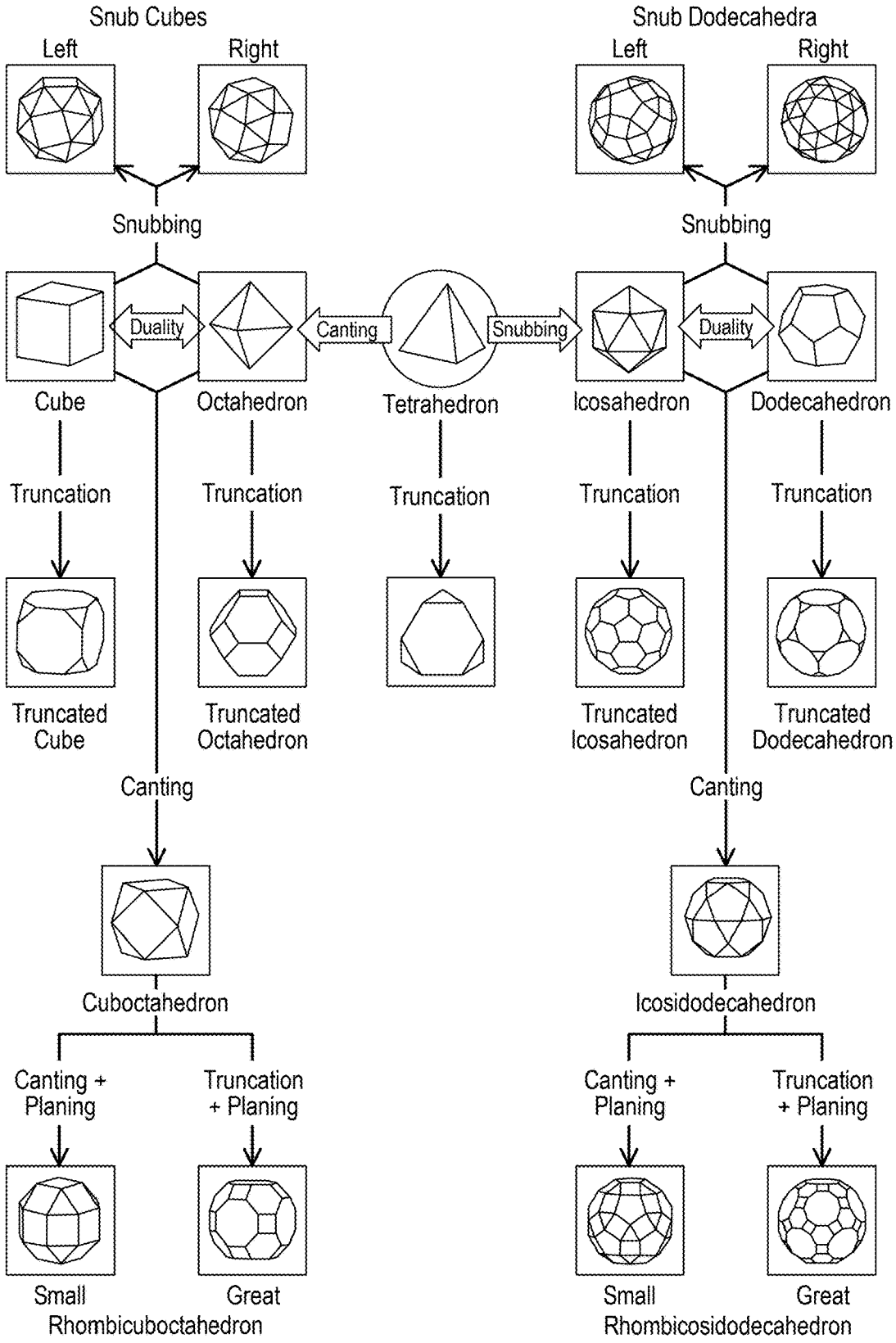

FIGS. 5 and 6 show additional information on truncation with respect some specific examples and relationships of different polyhedral solids via certain truncation operations.

Based on the above information about the truncation, examples for designing specific buildings over a foundation that is anchored and secured to the ground are described to illustrate various features of the disclosed technology. A building structure based on pre-fabricated flat panel components in polyhedronal facet shapes is assembled over a foundation on the ground to provide a sheltered space or an enclosed indoor space suitable for use as business space or dwelling space. This foundation can be implemented in various configurations, including conventional reinforced concrete foundation slabs commonly used in construction of certain residential buildings such as small apartment buildings, single family homes or condominiums buildings. In some implementations of the disclosed technology, the foundation may be formed by using pre-fabricated materials or components to eliminate the conventional on-site pouring concrete and construing reinforced concrete foundation. For example, the foundation may include a foundation frame formed by rigid pre-fabricated bars that are connected to one another and ground screws are engaged to the foundation frame to hold the foundation frame and to fix the foundation frame to the ground by inserting and fixing the ground screws into the ground. Each ground screw includes a rigid screw body which can be a solid metal or a metal tubular structure that are affixed to the foundation frame and a threaded tapered head to allow the ground screw to be rotated to penetrate into the ground for fixing and holding the foundation frame to the ground. Examples of ground screws and applications can be found in a 12-page document entitled "Ground Screw Systems, ESR-4226" (12 pages) issued March 2020 at https://www.americangroundscrew.com/wp-content/uploads/2020/03/ESR-4226.pdf and the following website of https://www.americangroundscrew.com/for a U.S. ground screw manufacturer, American Ground Screw in Iowa, whose ground screw products with screw diameters of 76 mm/3" and 114 mm/4.5" are listed in the California Building Code (https://www.dgs.ca.gov/BSC/Codes).

Over the foundation frame, one or more floor structures can be formed by pre-fabricated floor panels to engage to the foundation frame to form a floor of the building structure, and wall structures can be next formed by pre-fabricated wall panels over the floor and supported by the foundation frame to form exterior and interior walls of the building structure. A roof can then be formed by pre-fabricated roof panels above at least part of the wall structures to provide a sheltered space along with the walls.

Figure 7A:
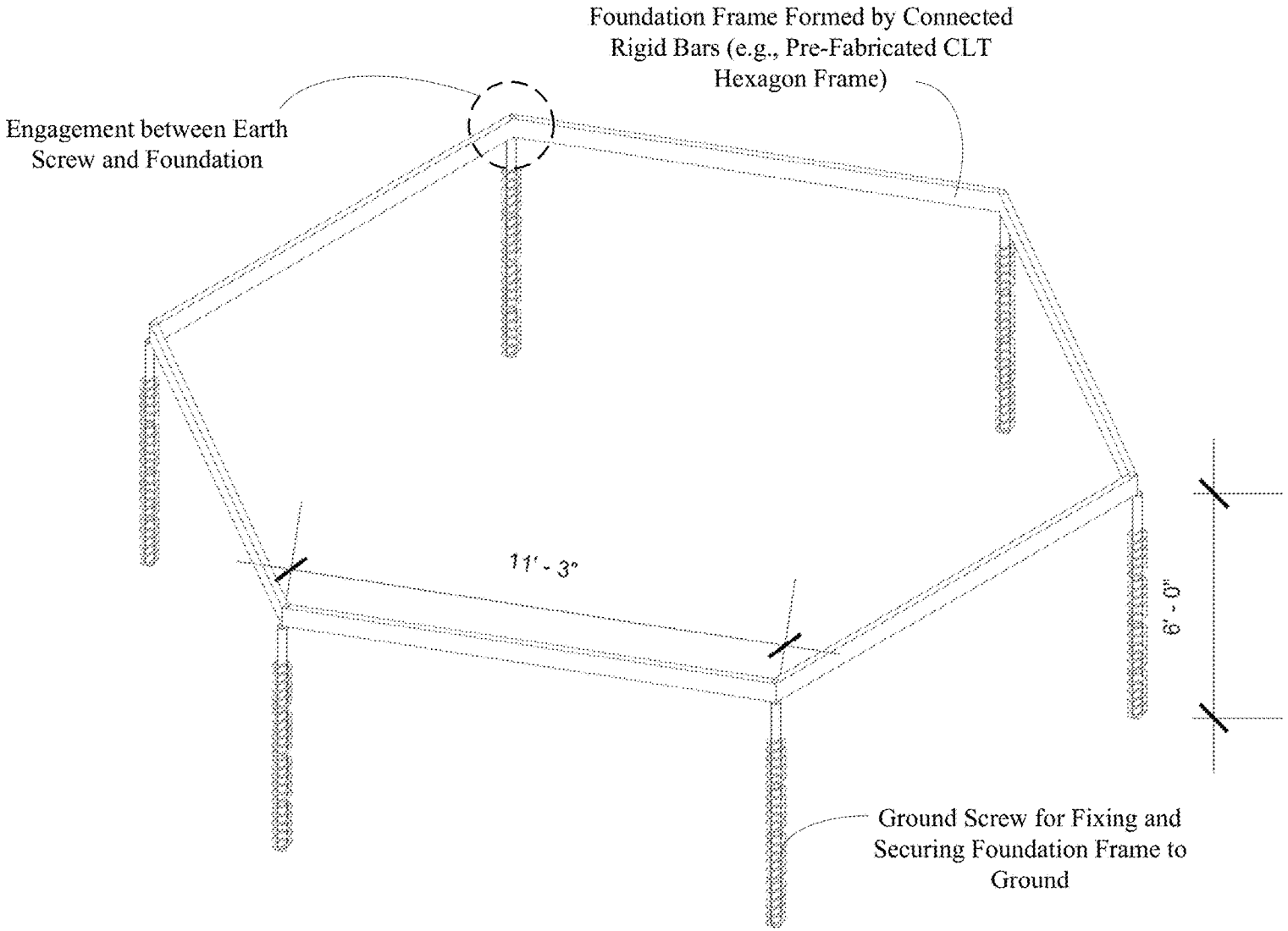
FIGS. 7A through 7N illustrate an example of a process of using pre-fabricated building panels with polygonal facets of truncated polyhedrons to assemble the house in FIG. 1A with hexagon features.
Figure 7C:
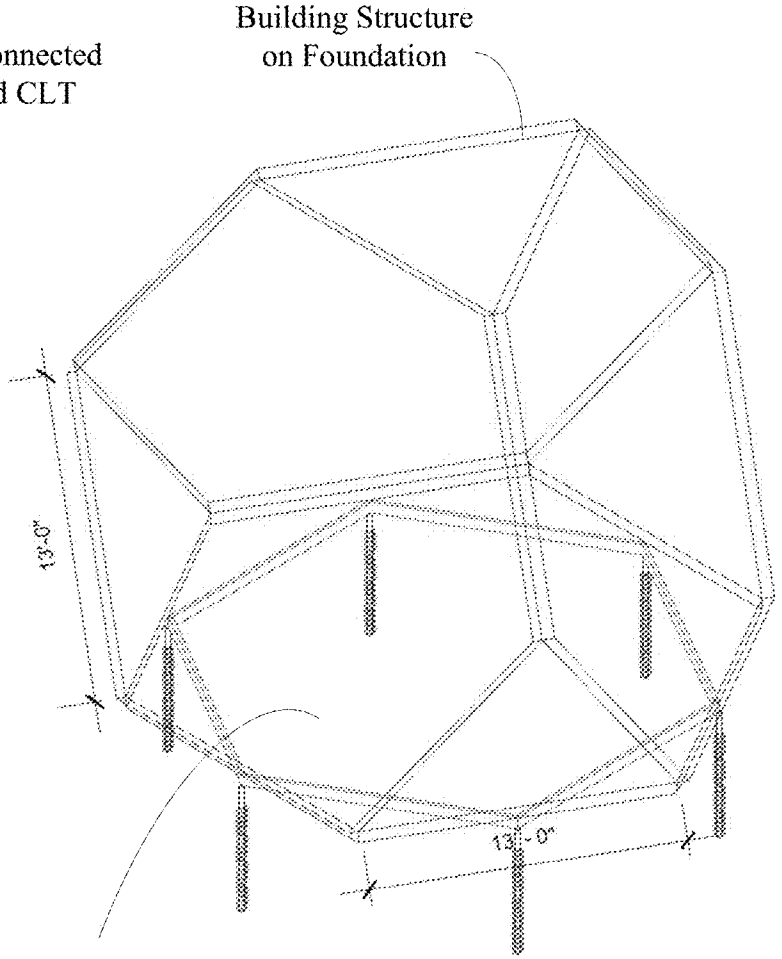
Figure 7B:
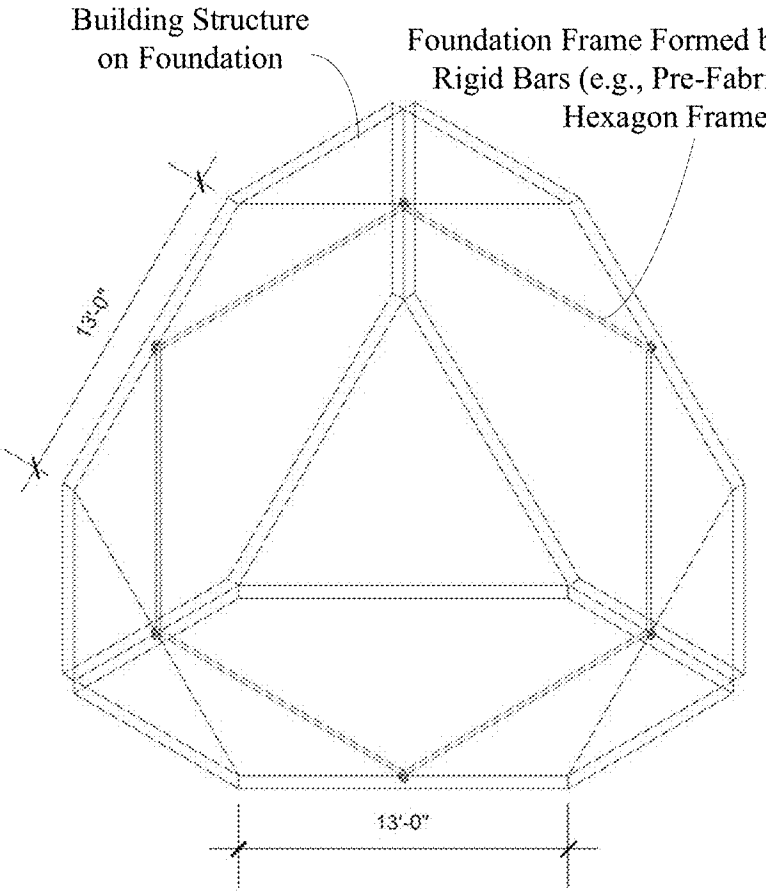
Figure 7D:
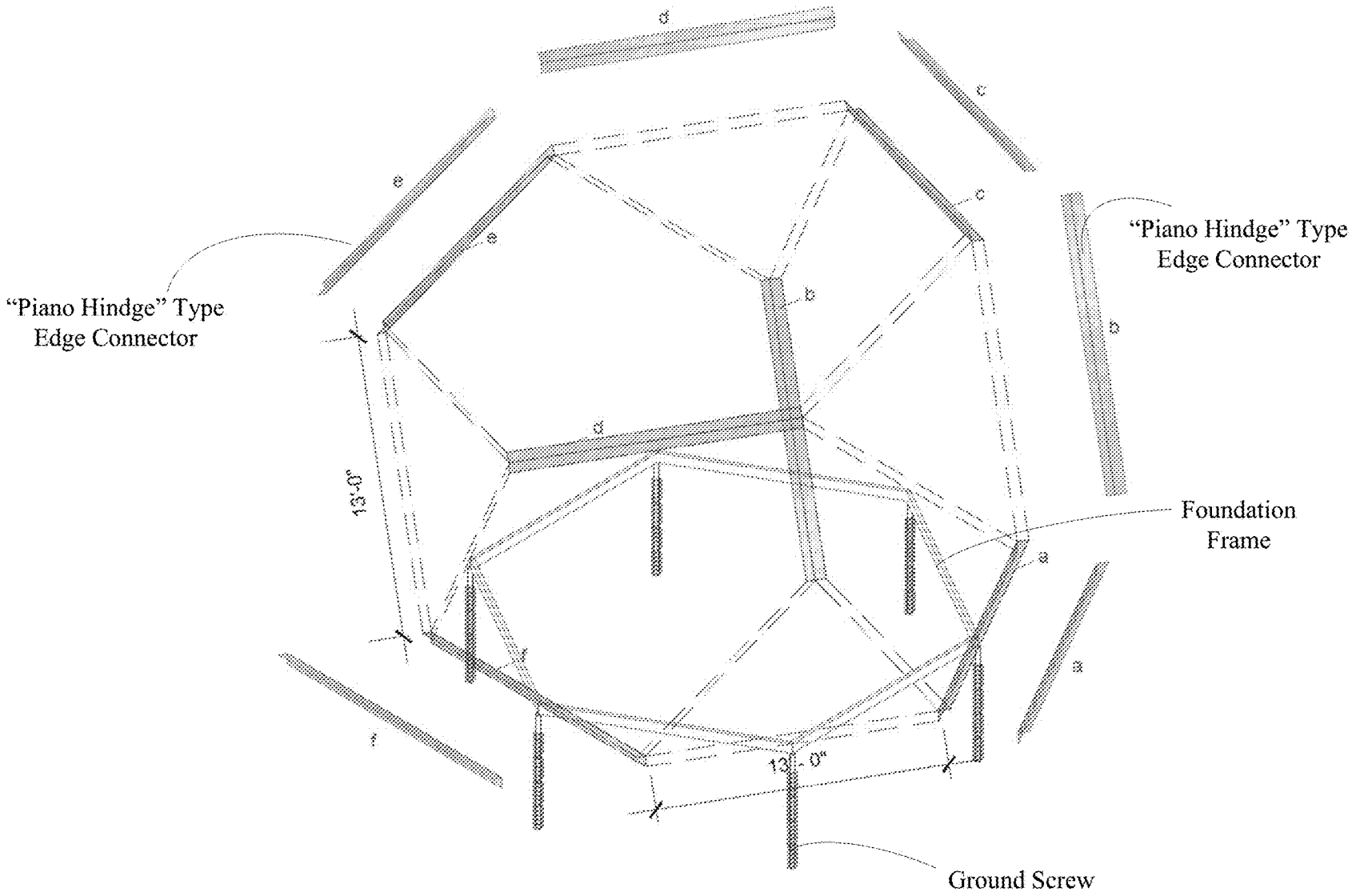
Figure 7E:
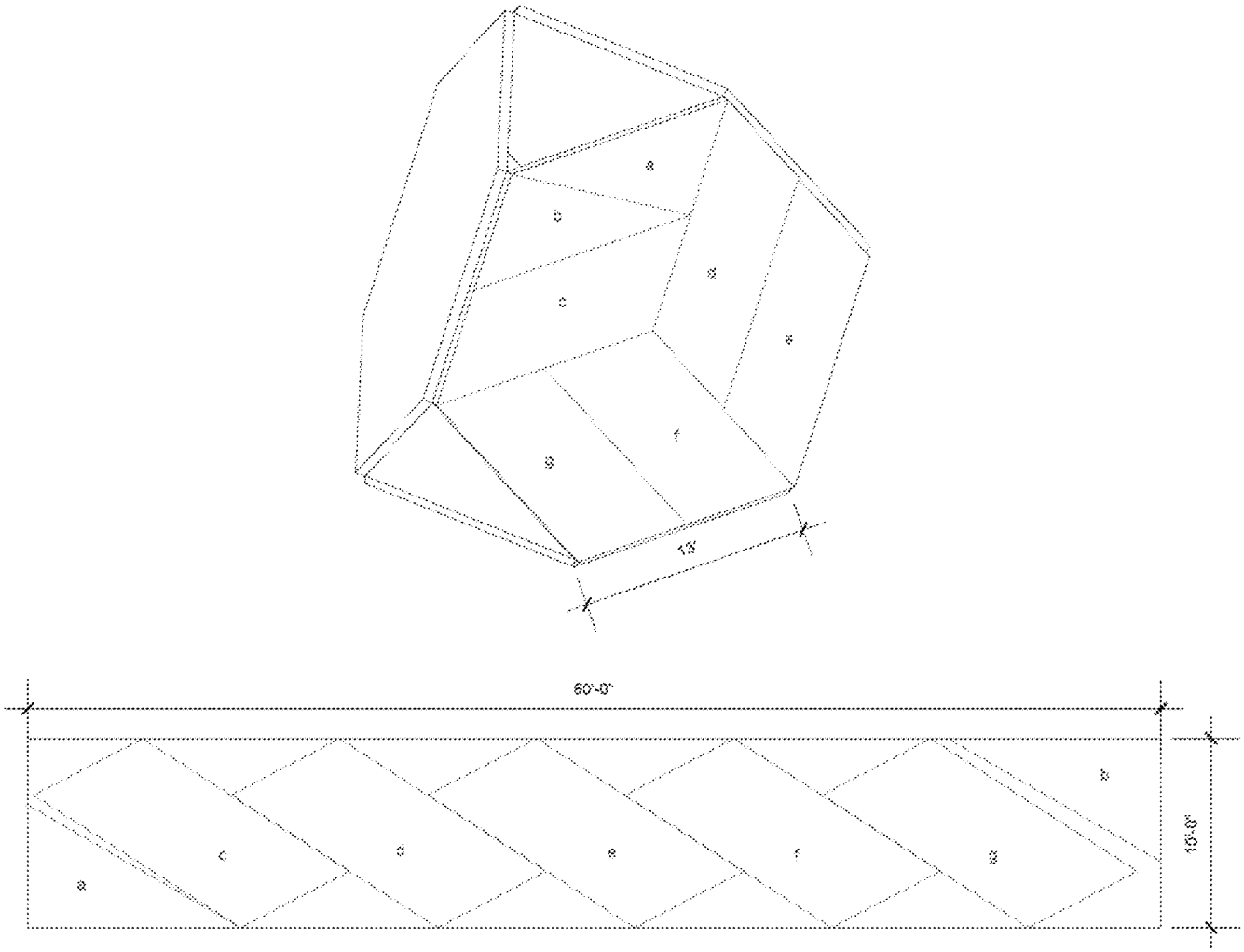
Figure 7G:
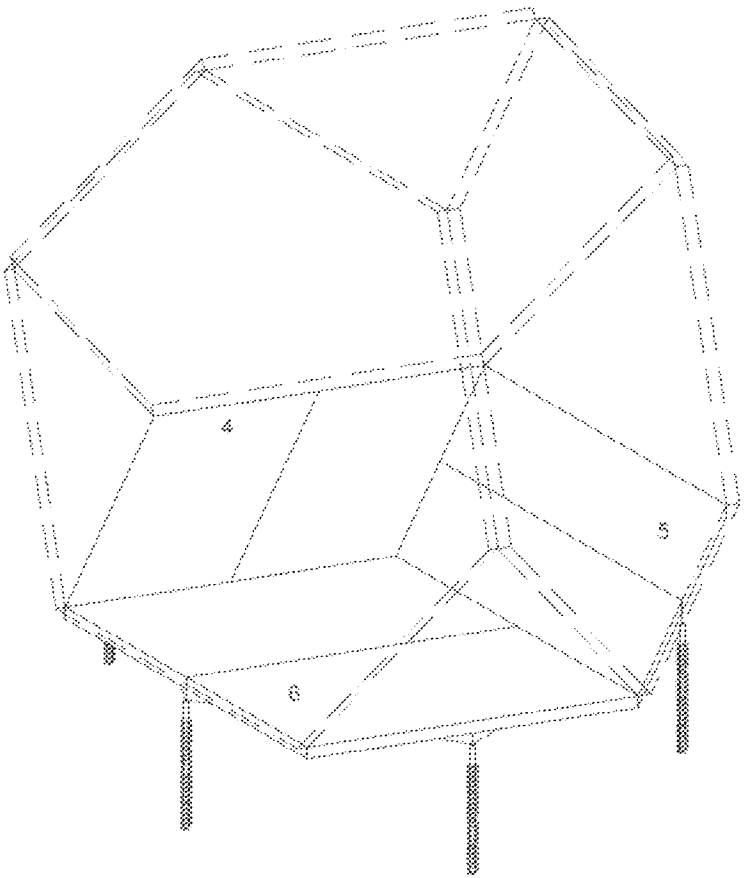
Figure 7F:
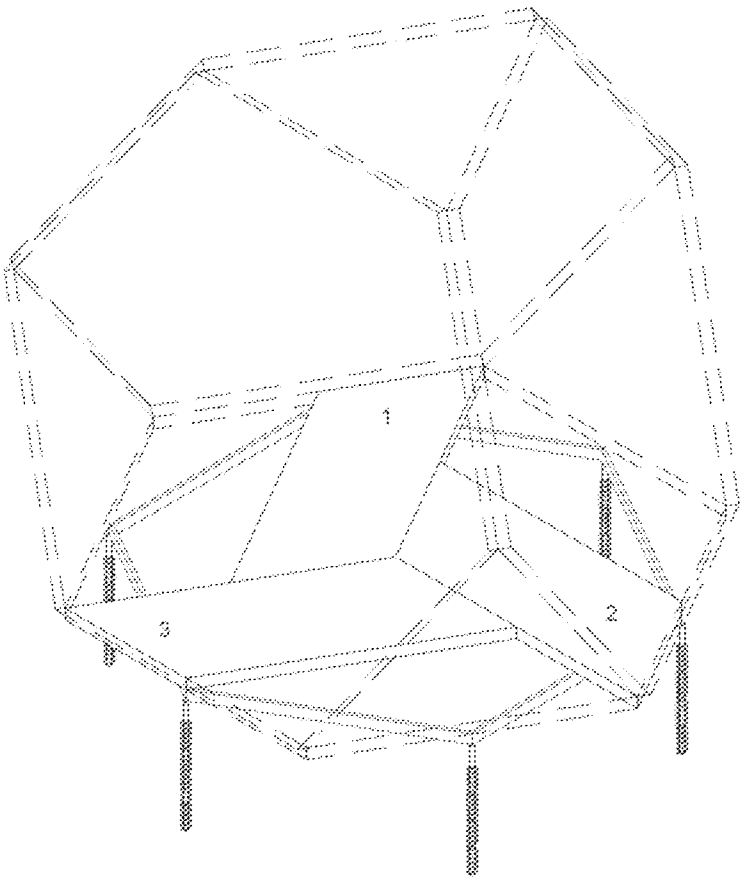
Figure 7H:
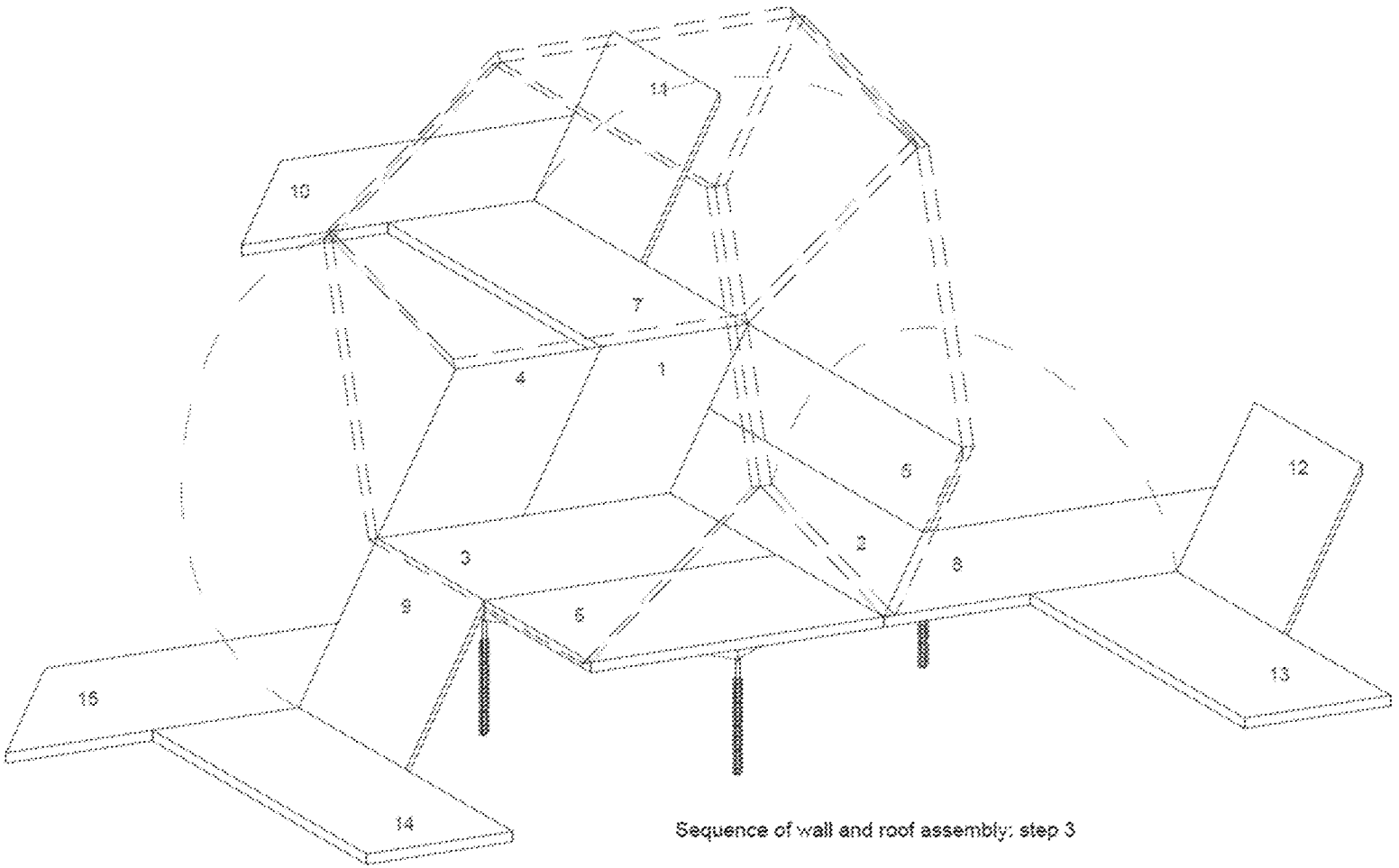
Figure 7I:
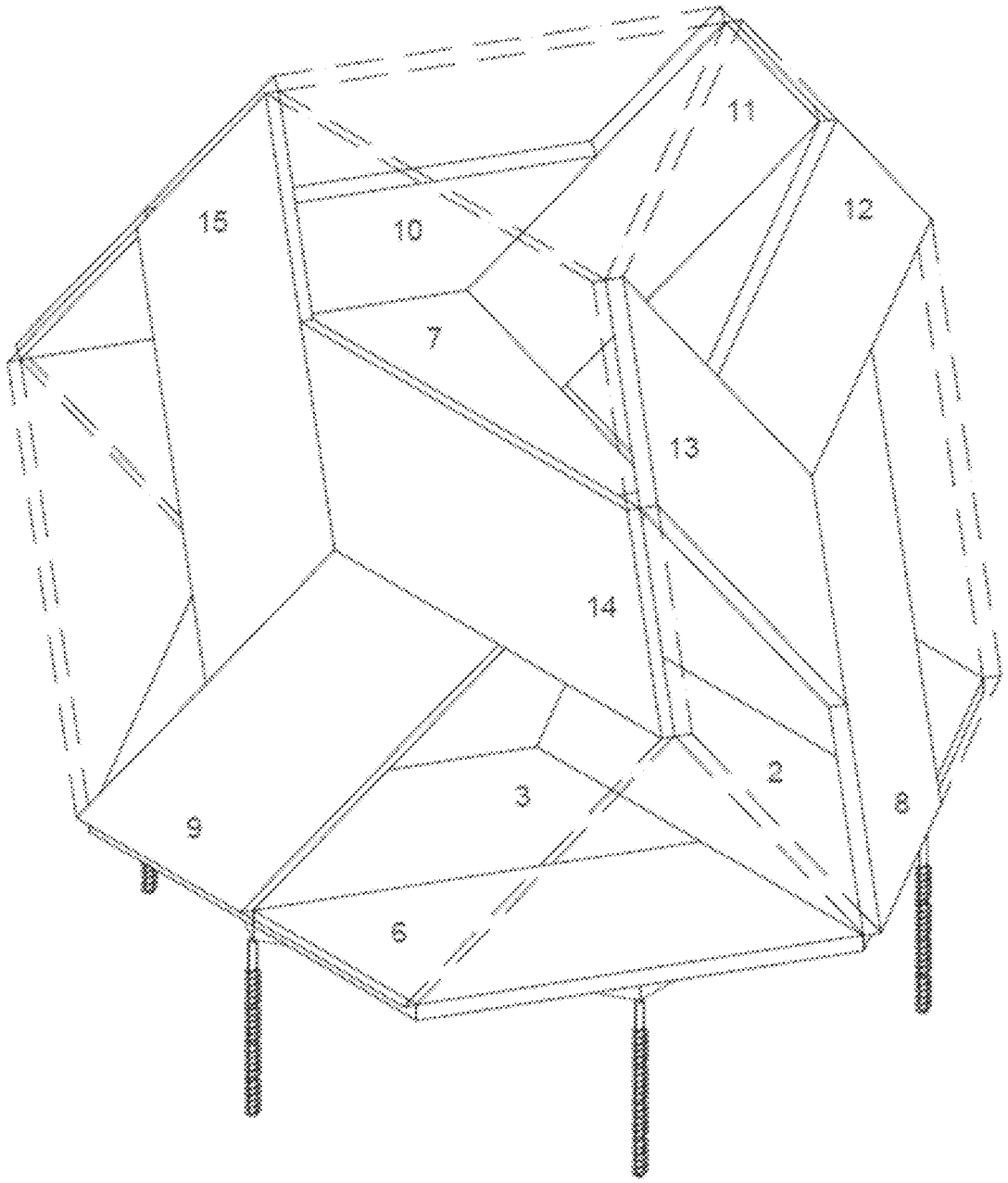
Figure 7K:
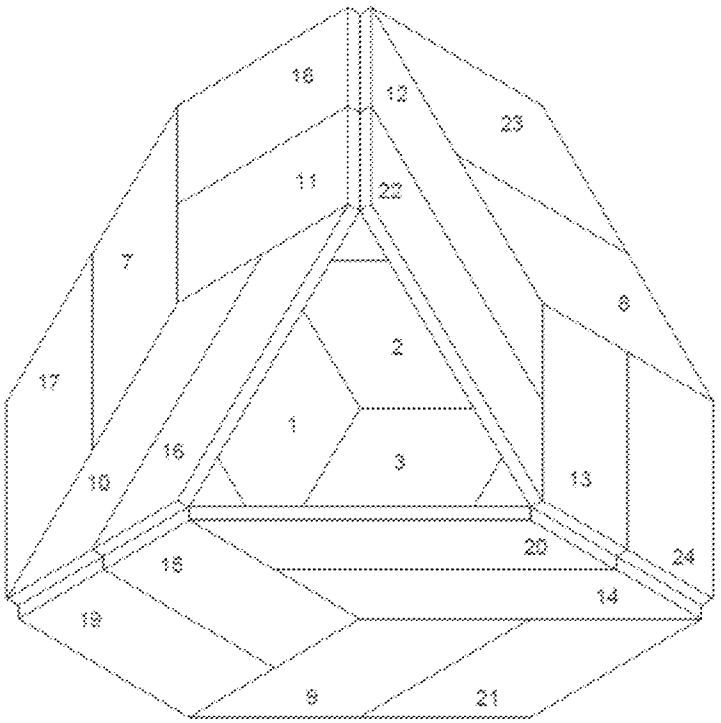
Figure 7J:
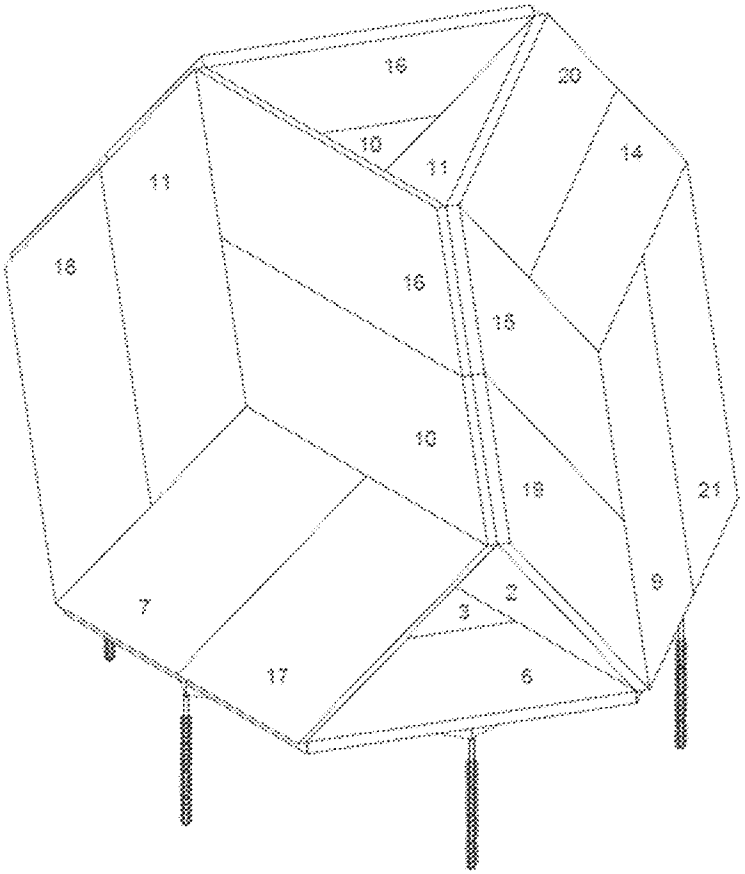
Figure 7M:
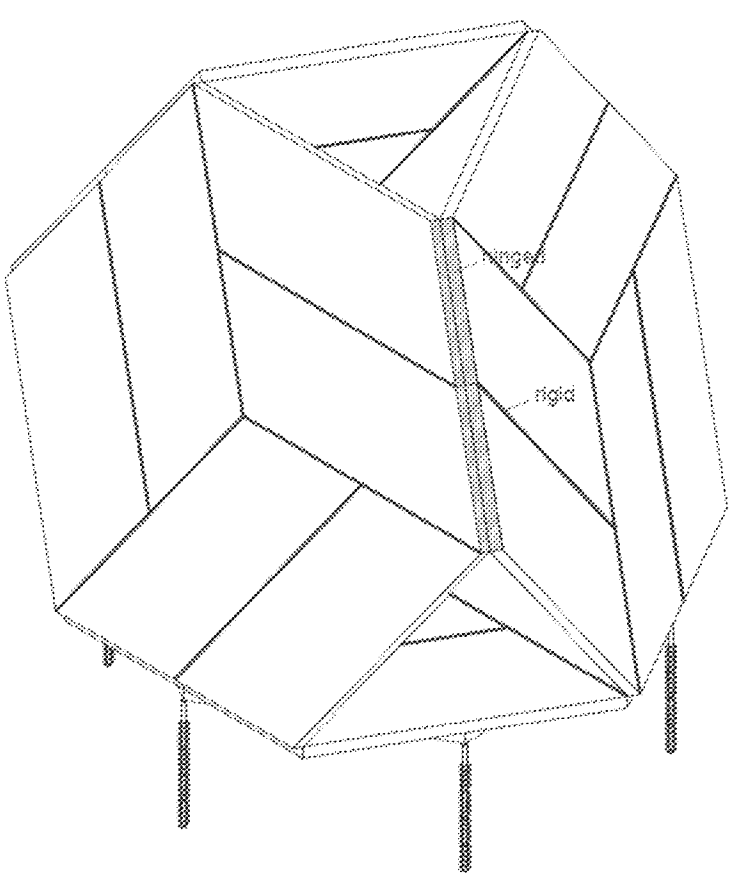
Figure 7L:
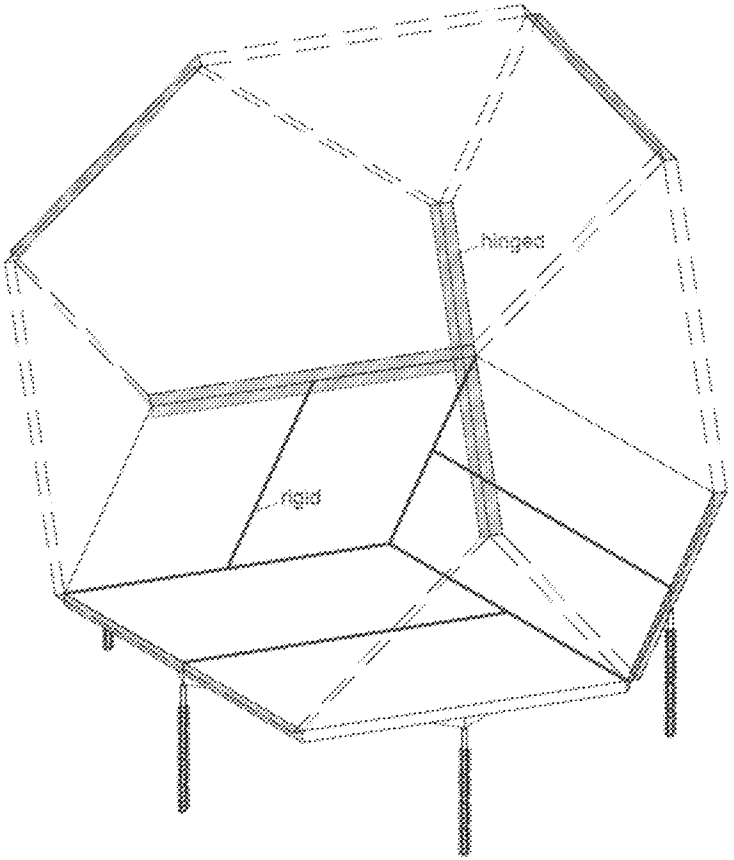
Figure 7N:
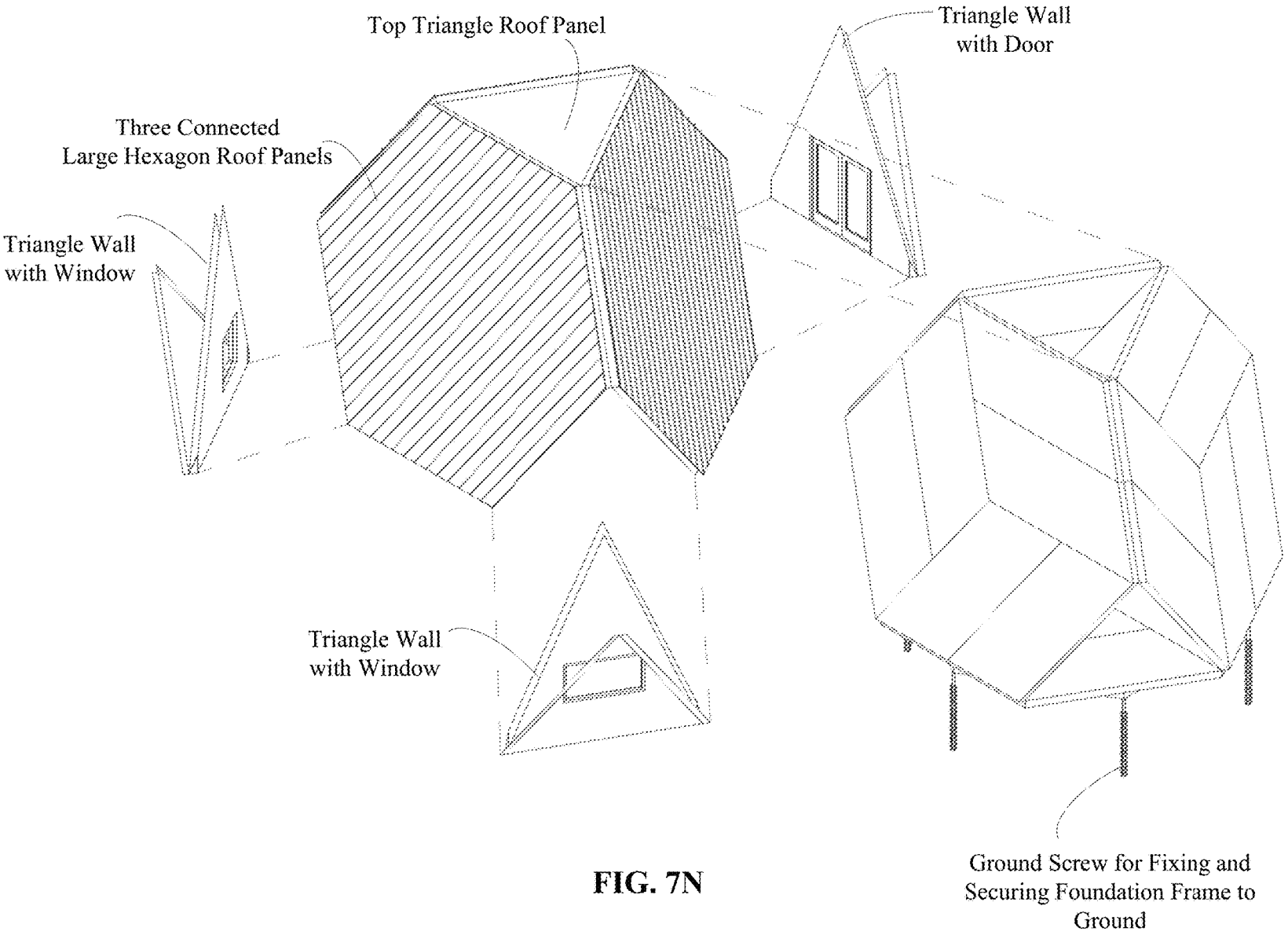

FIGS. 7A through 7N illustrate the construction of the house in FIG. 1A with hexagon features.

FIG. 7A shows an example of a hexagon foundation frame (illustrated in red), assembled on site and are anchored to the ground via bolts and screws or other suitable dry anchoring devices without the use of reinforced concrete. The specific anchoring example in FIG. 7A is ground screws that are placed at the apex positions of the hexagon foundation frame formed by pre-fabricated bars such as CLT bars or other composite wood bars.

FIGS. 7B and 7C show two views of the house structure of the house in FIG. 1A supported by the hexagon foundation frame shown in FIG. 7A. The house structure includes floors, walls and roofs formed with CLT panels in polygon facets which are joined (engaged) together to form a truncated three dimensional polyhedron (blue).

FIG. 7D shows a perspective view of the house structure where the floor, walls and roof are mostly regular rigid planes that are joined together at their edges using adjustable "piano-hinge" like bracket joints or edge hinge connectors. Such an edge hinge connector is formed on an edge of the panel body and includes a first flat part or hinge flap panel fixed to the panel body, a second flat part or hinge flap panel not affixed to the panel body, and a hinge to engage the first and second flat parts to each other to allow the second flat part to rotate with respect to the first flat part affixed to the panel body to connect to another construction building panel in a way similar to a piano hinge connector for a piano cover.

FIG. 7E includes a perspective view of the house structure to illustrate how smaller pre-cut and pre-fabricated CLT polygonal panels are tiled together to form larger panels for the floor, walls and roofs of the house. In addition, FIG. 7E illustrates that a large CLT panel is subdivided and cut into smaller regular polygonal panels in a way to maximize the area of a single large CLT panel of cross laminated timber material (e.g., 10 feet wide and 60 feet long). This cutting is performed at the CLT fabrication plant to generate specific polygonal CLT pieces by using computer driven and automated cutting machines as part of large scale CLT manufacturing process. The smaller polygonal CLT pieces are shipped to a construction site for assembling.

FIGS. 7F and 7G show a part of an example assembling process for forming the floor over the foundation frame. The polyhedral facet that constitutes the floor of the structure is subdivided into 6 regular polygons (parallelograms). FIG. 7F shows the first step for assembling the floor by joining three panels labeled as 1, 2 and 3 together following a pinwheel pattern bespoked from its center. FIG. 7G shows adding remaining three regular polygon panels labeled as 4, 5 and 6 (parallelograms) to arrive at the full surface of the polyhedral facet over the hexagon foundation frame.

FIG. 7H shows the process of assembling 9 regular polygon panels (parallelograms) to construct the walls and roof of the house in FIG. 1A. The three polyhedral facets that constitute the walls and roof of the structure are each subdivided into 6 regular polygons (parallelograms), three of which are joined together following a pinwheel pattern bespoked from its center. Specifically, the assembly for each of the three wall/roof facets (8,12,13), (9,14,15), (7,10,11) is shown.

FIGS. 7H and 7I collectively show assembling the additional regular polygon panels labeled 12, 13, 14 and 15 as part of assembly of the wall and roof structures.

FIG. 7J shows a perspective view of the result of assembling remaining three regular polygons (parallelograms) now joined to the others to complete the three wall/roof facets, to arrive at the total of 24 polygons, 6 which form each of the three faces: (16,17,18), (19,20,21), (22,23,24). FIG. 7K shows a top view of the structure.

FIGS. 7L and 7M illustrate inter-panel engagement by (1) a rigid joint and (2) a hinged connection joint. Each hinged connection joint is formed on the exterior edges of each of the four polyhedral solid facets (floor, walls and roof). Each rigid joint is used for joining the interior pieces that constitute each of these facets. Given the complete symmetry of the facets of the structure, once the hinged connection mechanisms join the four facets together, the structure gains full rigidity and ceases to move. One advantage of the "hinged" (piano-hinge) edge connection mechanisms is the possibility of assembling the faces flat on the ground and employing a "tilt-up" method for final assembly that does not require scaffolding.

FIG. 7N illustrates the final assembly of the prefabricated construction blocks that constitute the full structure, now serving as the structural core upon which the holes (drill-patterns) to accommodate different off the-shelf electrical, plumbing, insulation and roofing systems can be planned and installed into place in advance, robotically with a high degree of precision, to accommodate these as the final exterior "shell" of the enclosure. The structure's structural core, made of robotically prefabricated components allows for the flexibility to accommodate multiple off the shelf components to customize the exterior look and interior finishes of the structure as needed, even before delivery, and facilitating its assembly process.

The specific assembly process in FIGS. 7A through 7N is one example for a method for assembling pre-fabricated components to form a building structure that provides pre-fabricated construction building panels of varying shapes and sizes for forming floor, wall and roof structures of the building structure. Each construction building panel is structured to include a composite wood panel that includes different wood pieces that are laminated together and is shaped as a polygonal facet formed by truncating a solid three-dimensional polyhedron. The method includes different assembling steps: assembling a first group of the pre-fabricated construction building panels designed for a floor of the building structure together to engage to a foundation at a site of the building structure to form the floor; assembling a second group of the pre-fabricated construction building panels designed for walls of the building structure to engage to the floor or the foundation; and assembling a third group of the pre-fabricated construction building panels designed for a roof of the building structure to form the roof over at least part of the walls.

Figure 8:
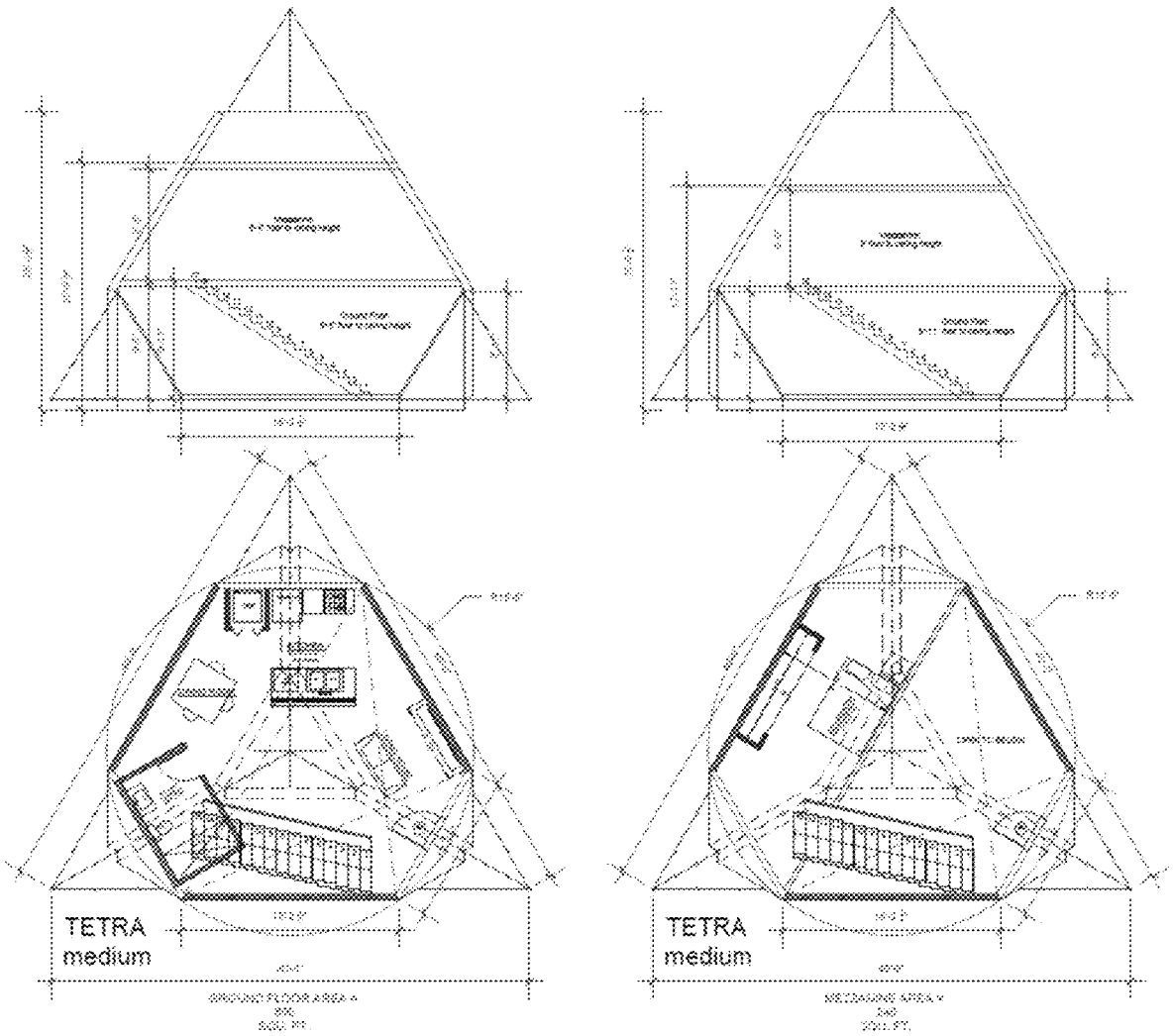
FIGS. 8, 9 and 10 show examples of designs using differently shaped pre-fabricated building panels with polygonal facets of different truncated polyhedrons from the design in FIGS. 7A through 7N.
Figure 9:
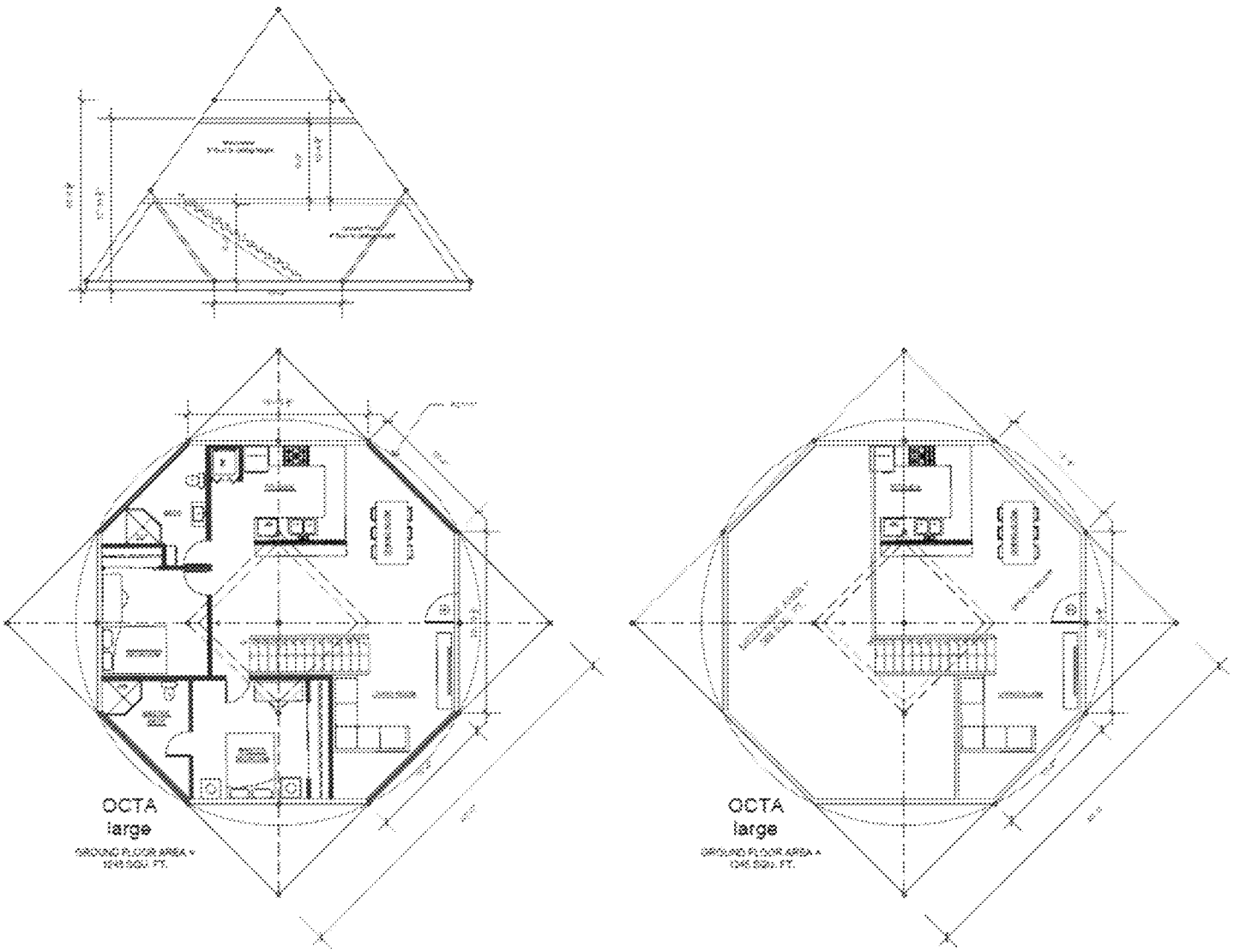
Figure 10:
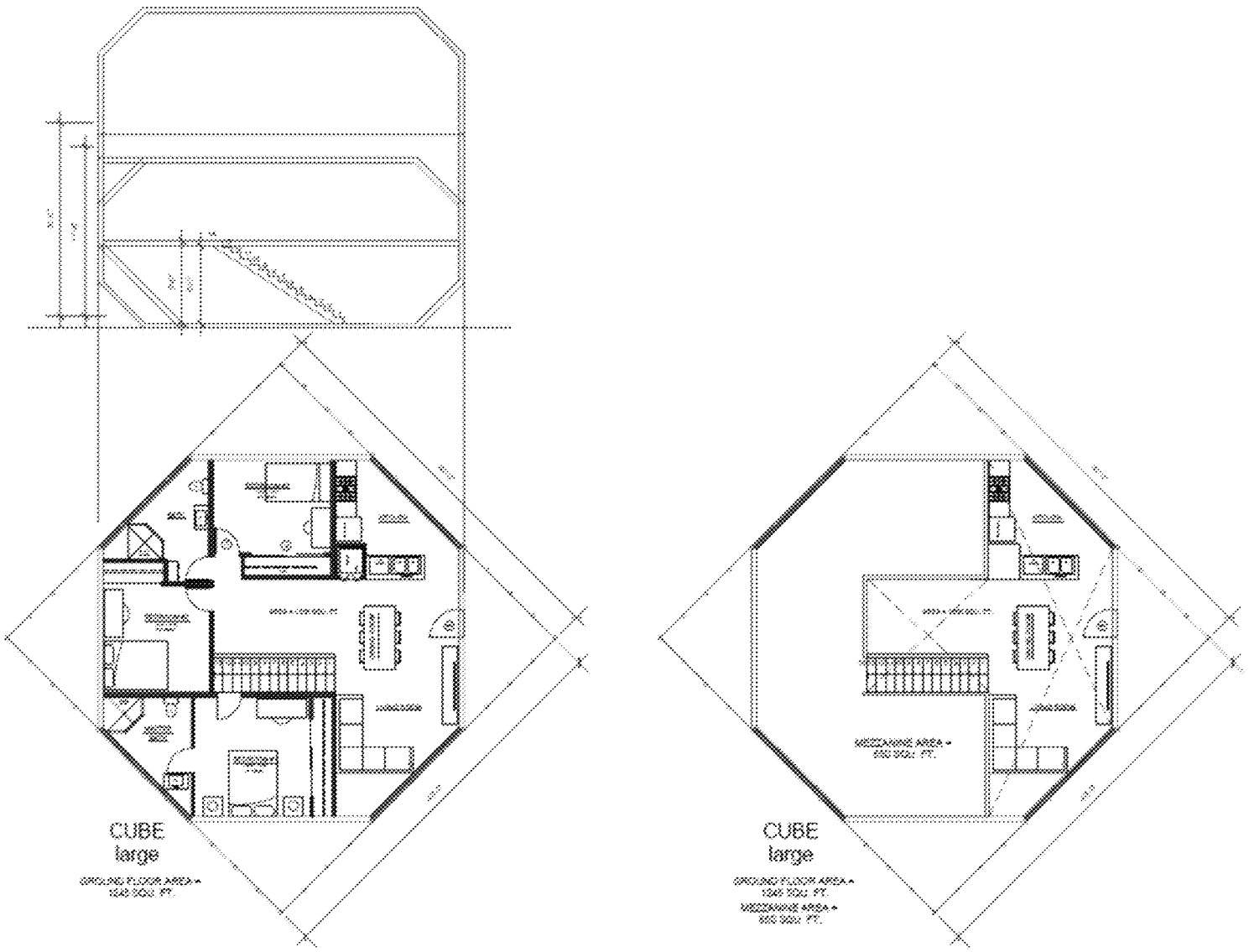

Different truncation geometries may be used to design a house with different structures and appearances on the same location of the house shown in FIGS. 1A and 7A-7N. FIGS. 8, 9, and 10 show examples of design plans with two floors based on (1) a truncated tetrahedron, (2) a truncated octahedron, and (3) a truncated cube, respectively.

The above examples provide specific implementations of the disclosed design technology for a customized building design for a residential home via on-site assembling of pre-fabricated flat panel components in polyhedronal facet shapes. In general, the result of this on-site assembly process using off-site pre-fabricated components is a customized building structure for providing a sheltered space or an enclosed indoor space suitable for use as business space or dwelling space. Such a building structure can include, among others, a foundation frame structured to engage to the ground to support the building structure; pre-fabricated floor panels connected to one another and to engage to the foundation frame to form a floor of the building structure; pre-fabricated wall panels supported by the foundation frame over the floor to form wall structures of the building structure; and pre-fabricated roof panels connected to one another to form a roof structure that is positioned above at least part of the wall structures. The floor panels, the wall panels or the roof panels include polyhedral panels shaped in polygon facets of a truncated three-dimensional polyhedron and are made from a pre-manufactured material such as artificially synthesized construction materials, composite wood structures or materials having different wood pieces that are laminated together (e.g., CLT materials). The truncated three-dimensional polyhedron can be selected from various geometries to achieve different structures and appearances of the final building structure selected by customers. Examples of truncated three-dimensional polyhedrons include, e.g., a cube, a tetrahedron, an octahedron.

Another aspect of the disclosed technology is to provide a system for using an Internet-based software application and computers and computer servers to provide online services for assembling customized homes or office buildings based on pre-fabricated and standardized construction building panels of varying shapes and sizes. As a specific example, such a construction building panel is structured to include a composite wood panel that includes different wood pieces that are laminated together and is shaped as a polygonal facet formed by truncating a solid three-dimensional polyhedron. Such a system can be used to establish a new business model for assembling customized homes or office buildings to bring customized designs to a mass market and to bring key participating entities in the construction industry to a more efficient ecosystem for high quality building construction at fair prices. Such a system can bring computer-based automation, artificial intelligence features and highly flexible and efficient design processes into the building construction industry and reduce the risks for the construction industry by enabling earlier purchase decisions, transactions and payments before the completion of the construction of buildings.

Figure 11A:
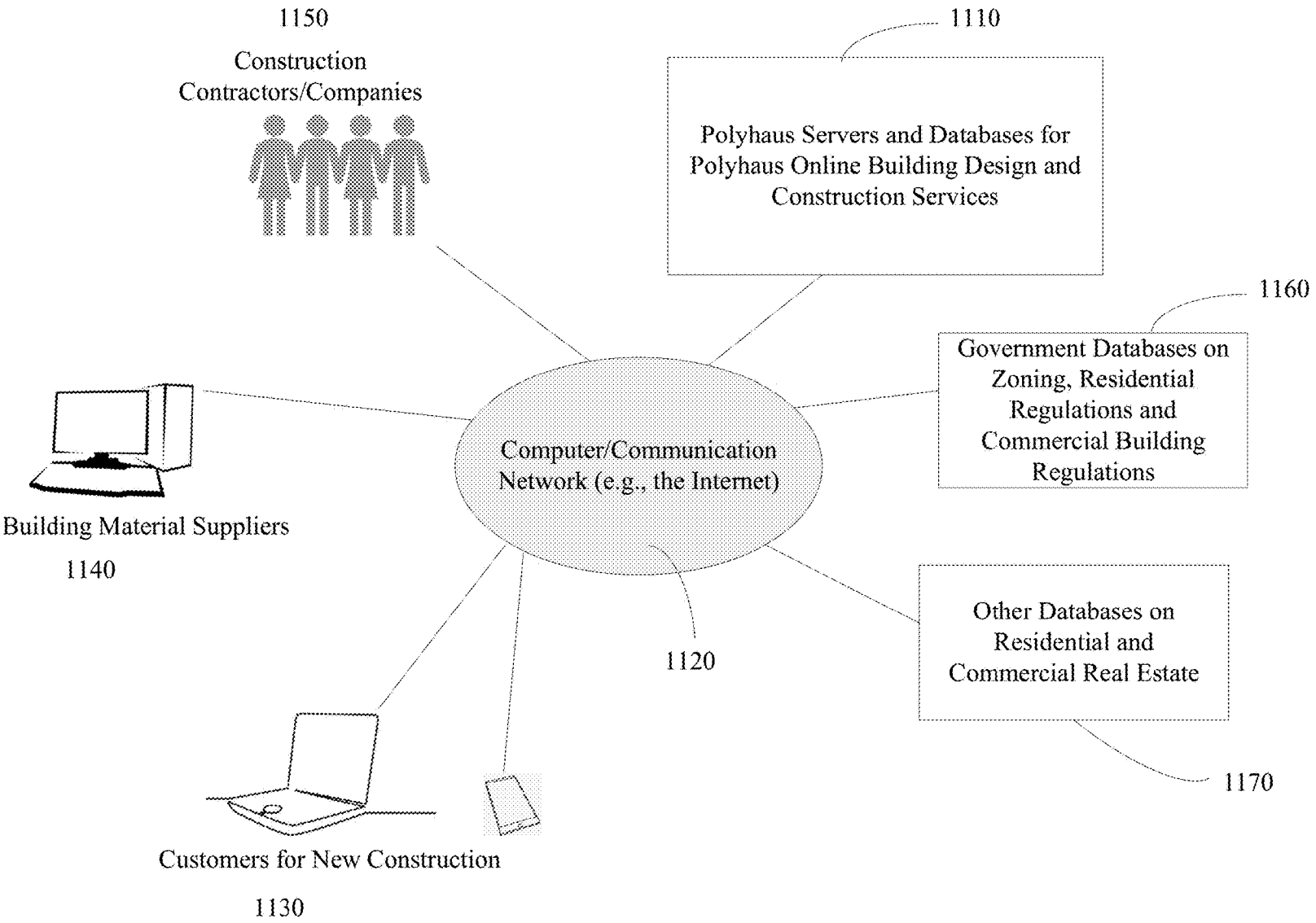
FIGS. 11A and 11B show an example of an online building design, construction and selling system based on the disclosed technology.
Figure 11B:
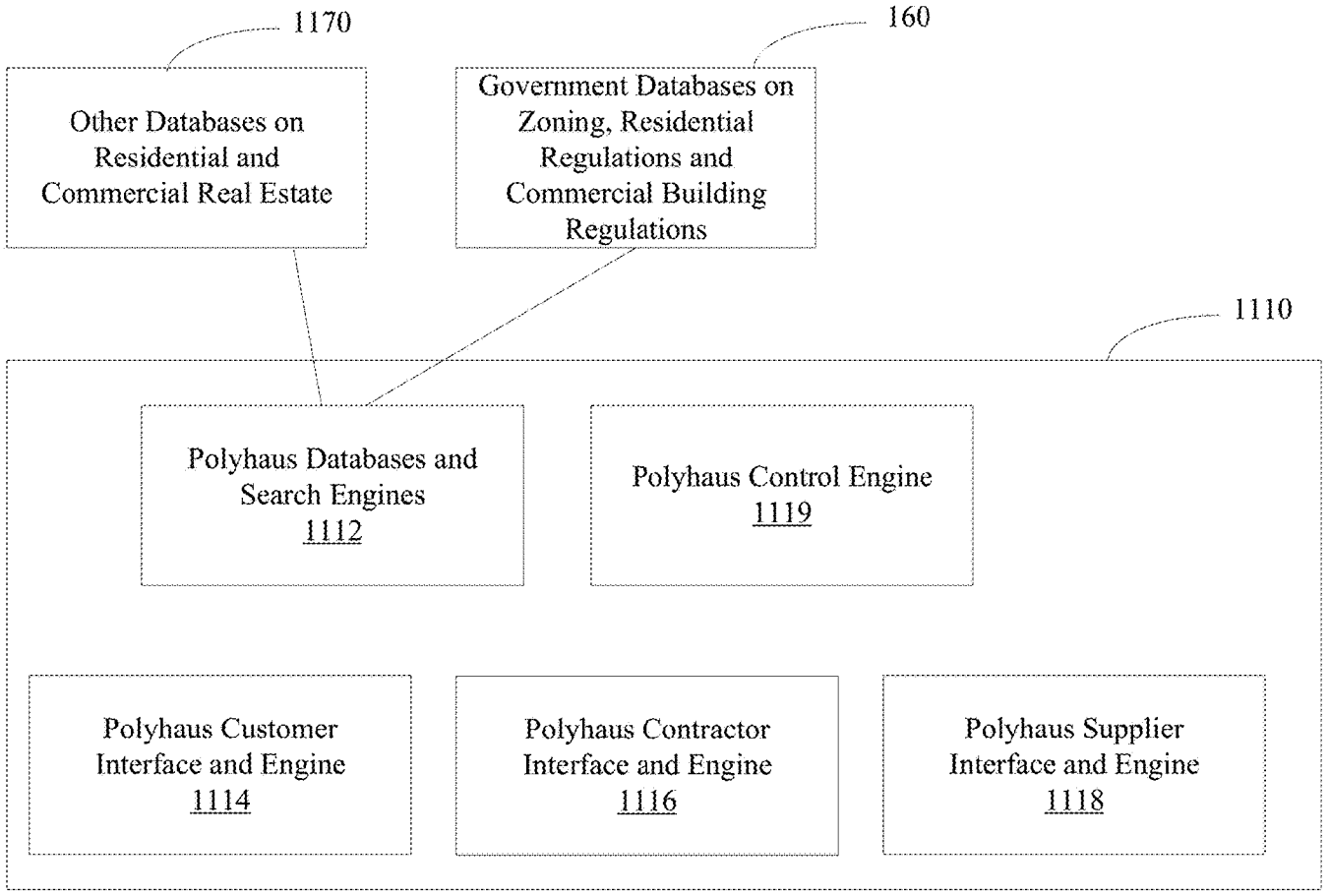
Figure 12A:
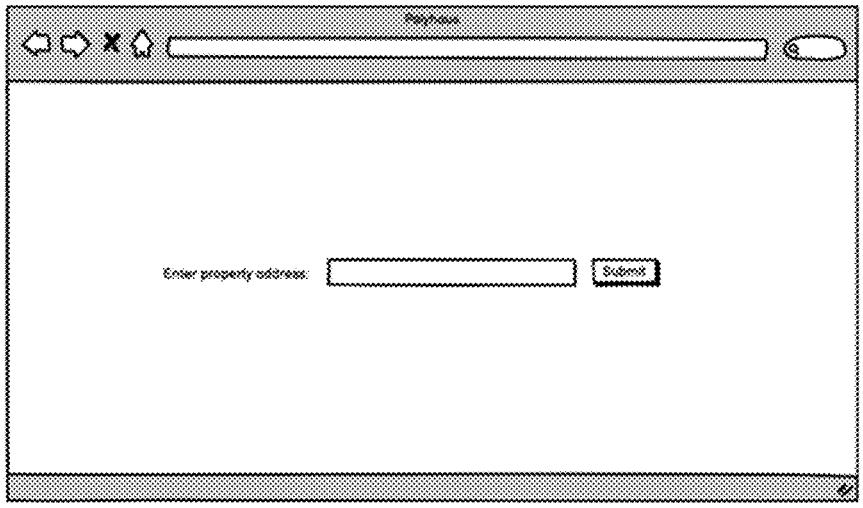
FIGS. 12A through 12F show examples of user interface features and functions of a customer interface module in the system in FIGS. 11A and 11B.
Figure 12B:
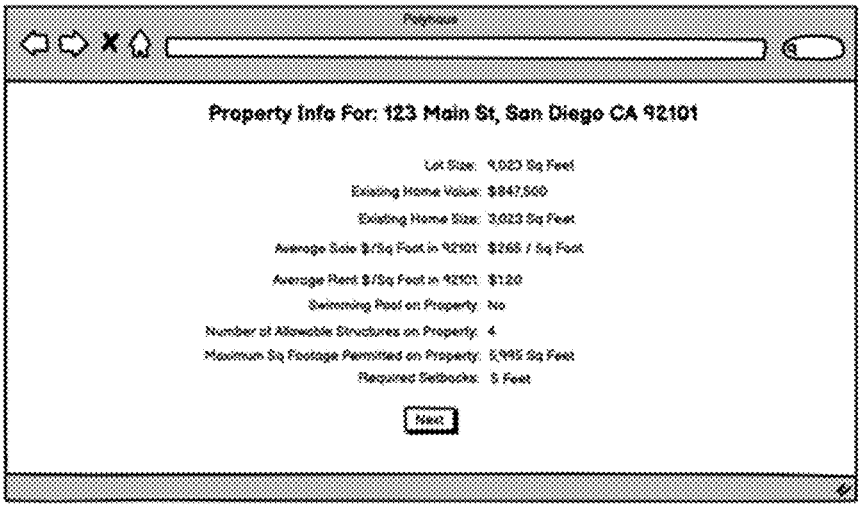
Figure 12C:
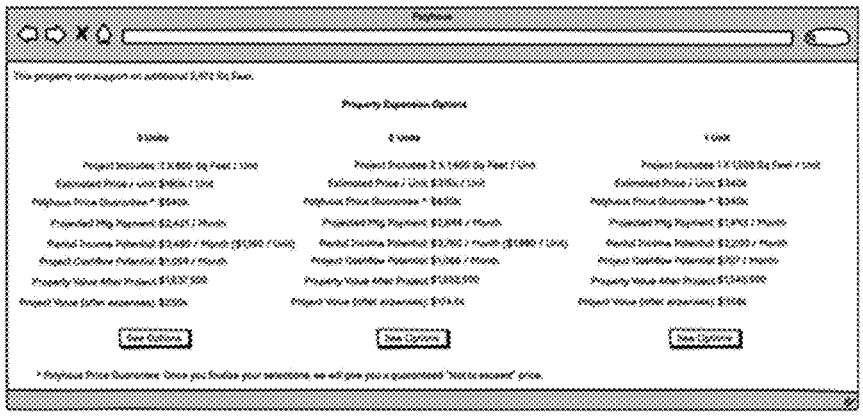
Figure 12D:
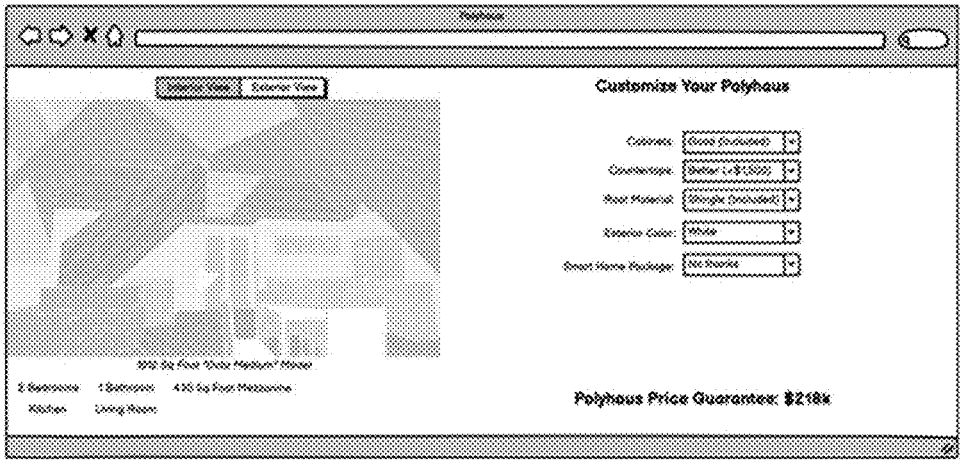
Figure 12E:
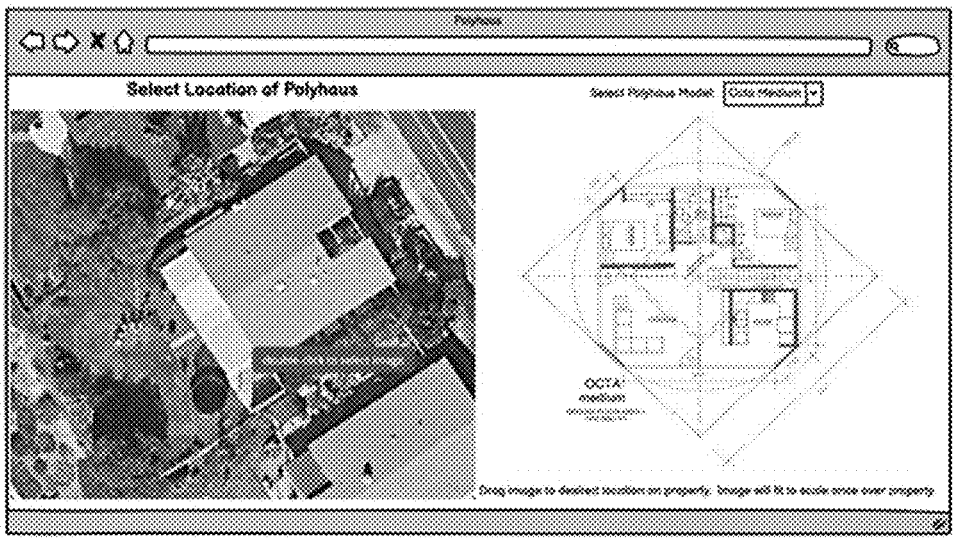
Figure 12F:
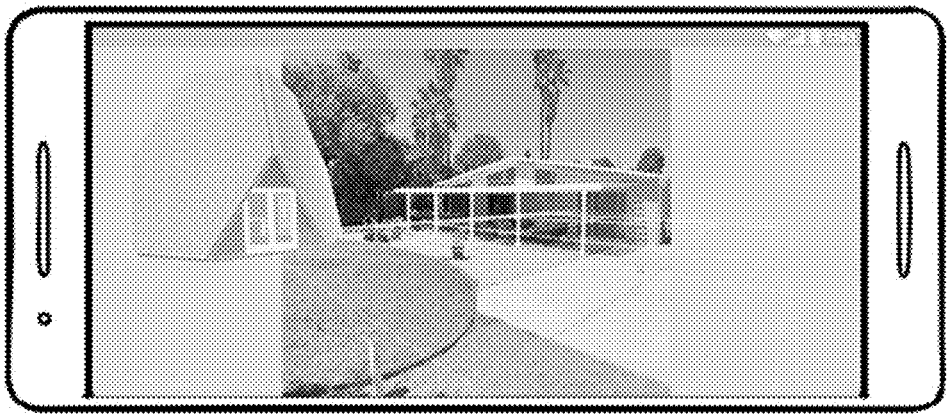

FIGS. 11A and 11B show an example of a building design, construction and selling system based on the disclosed technology. This system includes system servers and databases 1110 that form the core online computing infrastructure of the system as further illustrated in FIG. 11B. The system servers and databases 1110 are linked to one or more communication or computer networks 1120 to serve customers 1130 for new construction, building material suppliers 1140 and construction contractors 1150. In addition, the system servers and databases 1110 may access, via the communication or computer networks 1120, governmental databases and servers 1160 on zoning regulations and building codes, and third party databases or servers 1170 for relevant data and information for construction of office buildings and homes, material suppliers, shipping services and construction contractors.

FIG. 11B shows an example of the system servers and databases 1110 that includes system databases and search engines 1112 for collecting and maintaining information from governmental databases and servers 1160 on zoning regulations and building codes, and third party databases or servers 1170 for relevant data and information for construction of office buildings and homes, material suppliers, shipping services and construction contractors. The system includes 3 key modules to allow the service provider to use the system in FIG. 11A to reach out a large number of participants in the construction and building purchase and sell markets.

The first module is a system customer interfacing module 1114 configured to be operable to provide a customer interface to enable a customer 1130 to provide information on a customer building to be constructed, to provide design options, building costs and building schedules for the customer building in compliance with local zoning regulations and building codes and to complete a purchase of a customer selected design for the customer building.

The second module is a supplier interfacing module 1116 in communication with the customer interfacing module 1114 and operable to receive information of building materials and construction schedule for the customer selected design for the customer building based on pre-fabricated and standardized construction building panels of varying shapes and sizes. The supplier interfacing module 1116 is operable to interact with registered suppliers 1140, via a supplier interface, to solicit bidding from the registered suppliers 1140 and to select bid offers to order the building materials from one or more selected registered suppliers for delivery to a location of the customer building based on the construction schedule for the customer selected design for the customer building.

The third module in the system is a contractor interfacing module 1118 in communication with the customer interfacing module 1114 and operable to receive information of the construction of the customer building under the customer selected design. The contractor interfacing module 1118 is operable to interact with registered contractors 1150 with certification to perform construction using pre-fabricated and standardized construction building panels, to solicit, via a contractor interface, bidding from the registered contractors 1150 and to select bid offers for assembling the customer building based on the construction location and construction schedule. The customer interfacing module 1114, the supplier interfacing module 1116 and the contractor interfacing module 1118 collaborate to perform operations for completing construction of the customer building based on the customer selected design. This collaboration can be enhanced by providing a system control engine or module 1119 that coordinates and facilitates the information flows of the different modules to ensure proper execution of various operations in the design, construction and sell-purchase of the buildings.

FIGS. 12A through 12F shows examples of the user interface and its operations of the customer interfacing module 1114, including virtual reality type visual presentation of a customer home construction to a customer.

Figure 13A:
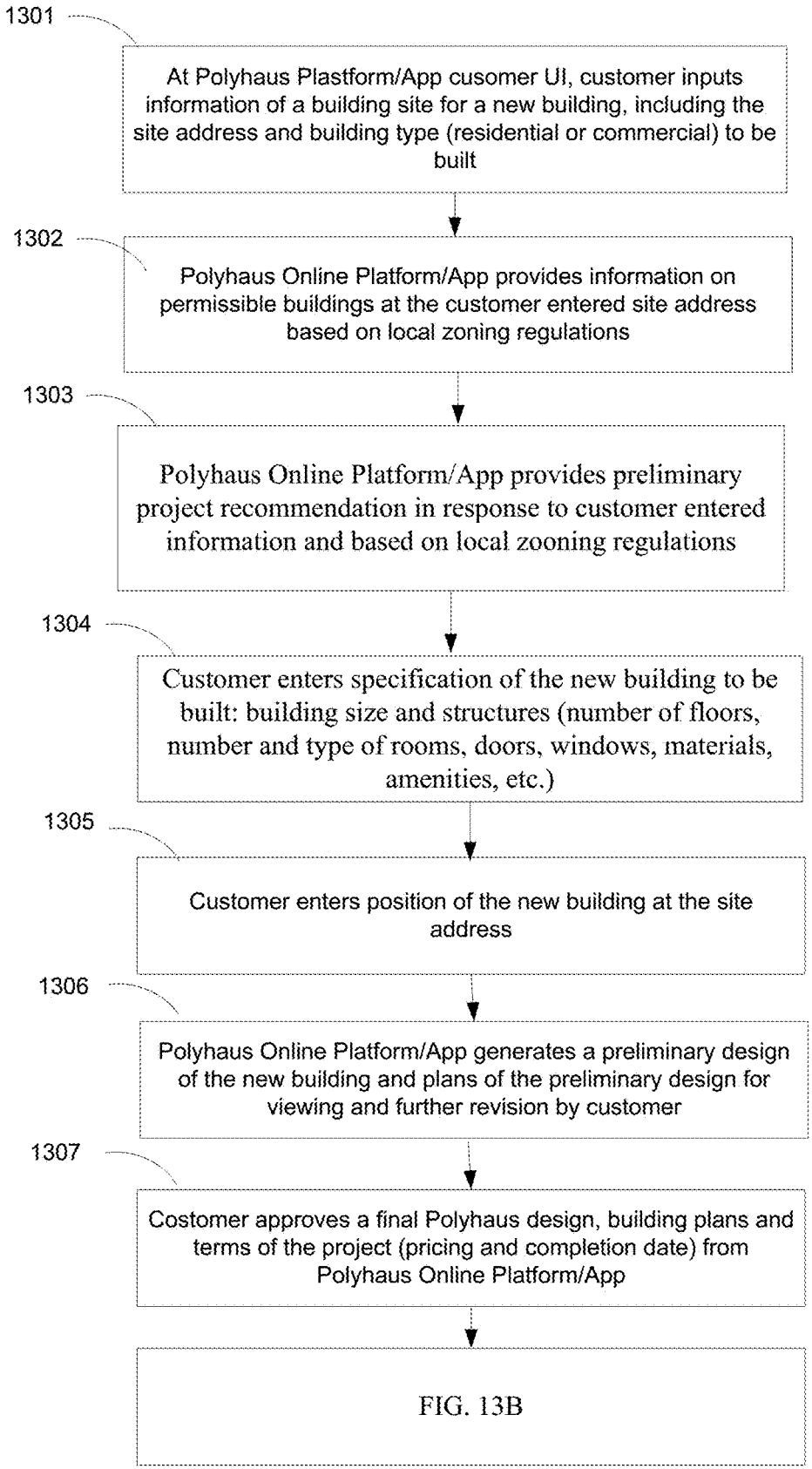
FIGS. 13A, 13B, 14 and 15 illustrate examples for implementing various features of the online building design, construction and selling system in FIGS. 11A and 11B based on the disclosed technology.
Figure 13B:
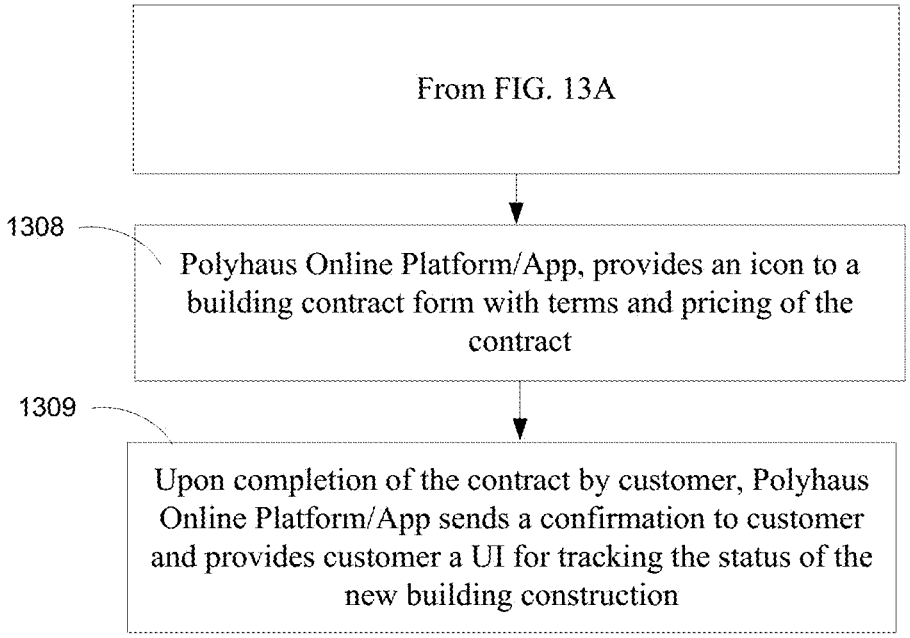

As an example shown in FIG. 13A and FIG. 13B, the customer interfacing module 1114 can be designed to provide a customer interface to enable a customer to provide information on a customer building to be constructed, including information on a location of the customer building; presents to the customer, using the customer interface, relevant zoning information based on local zoning regulations, the relevant zoning information including a parcel number and lot size of the location of the customer building, occupancy classification, Zone information, allowable height and set-backs, building Data, floor-to-area (F.A.R) calculations; and provides to the customer, using the customer interface, design options for the customer building for a customized design having structures and components that can be formed by using pre-fabricated and standardized construction building panels in response to building requirements from the customer. The design options include pre-approved design plans in compliance with the local zoning regulations and applicable building codes according to available geometries for the construction building panels based on truncated solid three-dimensional polyhedrons including: truncated tetrahedrons, truncated octahedrons, truncated cubes and/or other polyhedral shapes. The customer interfacing module 1114 also provides to the customer, using the customer interface, estimated cost and building construction schedule for each of the design options to facilitate the customer to select one of the design options; and enables the customer, using the customer interface, to select one of the design options and approve a purchase contract for a customer selected design option. Furthermore, the customer interfacing module 1114 provides to the customer, using the customer interface, a notification for beginning of the performance of the purchase contract for the customer selected design option and updates on progress and remaining schedule in construction of the customer building under the customer selected design option.

Figure 14:
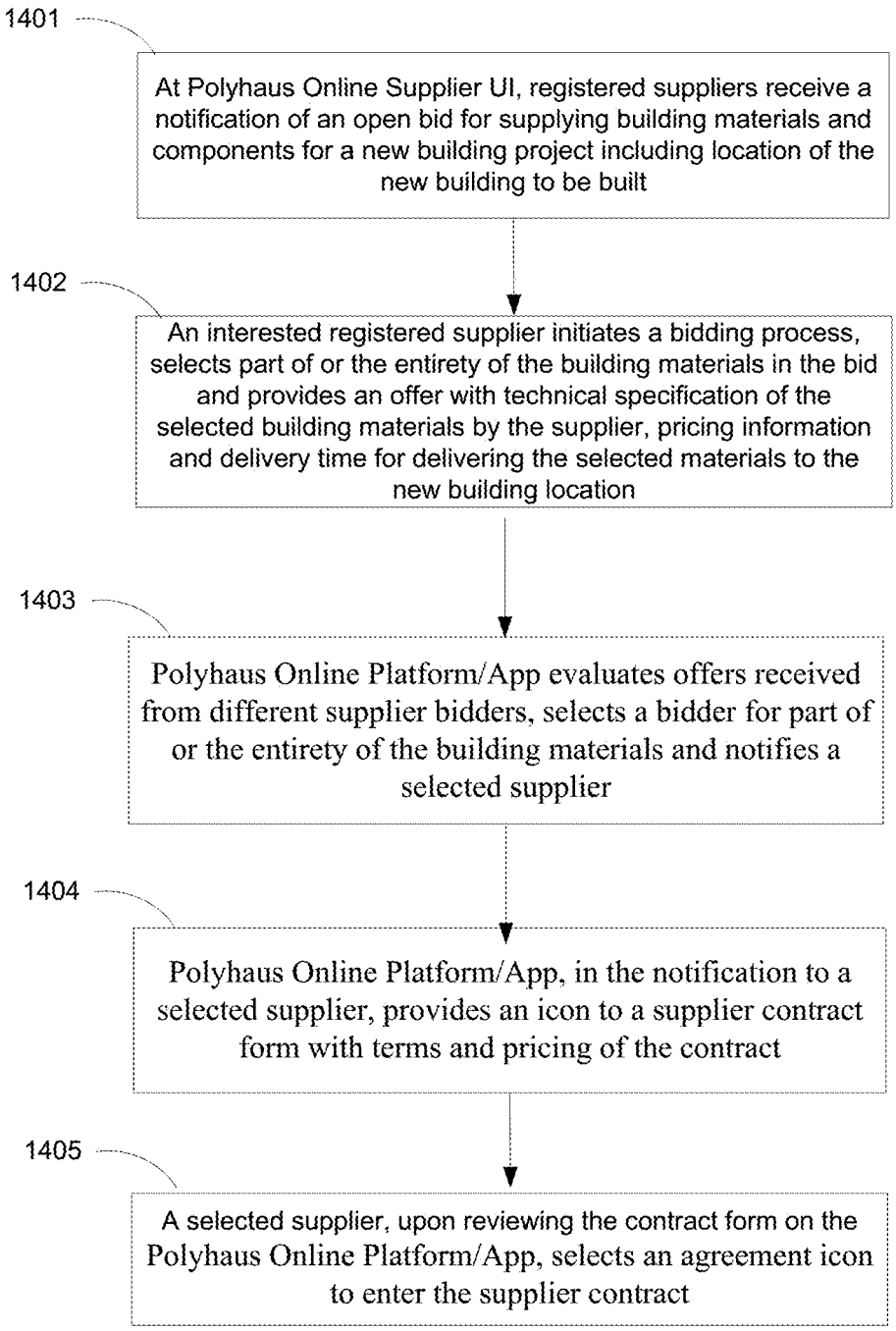

FIG. 14 shows an example of a process flow for operations of the supplier interfacing module 1116. In this example, the supplier interfacing module 1116 provides a supplier interface to enable suppliers to register as registered suppliers for bidding supply of building materials for assembling customized homes or office buildings; provides to the registered suppliers, using the supplier interface, an invitation to bid for supplying a list of building materials and pre-fabricated components including construction building panels shaped in polygonal facets from truncated solid three-dimensional polyhedrons for a customized design; and enables a registered supplier, using the supplier interface, to enter a bid for the listed building materials and pre-fabricated components. The supplier interfacing module 1116 further informs registered suppliers, via the supplier interface, a status of the invitation to bid for supplying the listed building materials and pre-fabricated components; notifies one or more selected registered suppliers of acceptance of their bids for supplying the listed building materials and pre-fabricated components; and enables a selected registered supplier, via the supplier interface, to enter a purchase contract for supplying a part of or an entirety of the listed building materials and pre-fabricated components.

Figure 15:
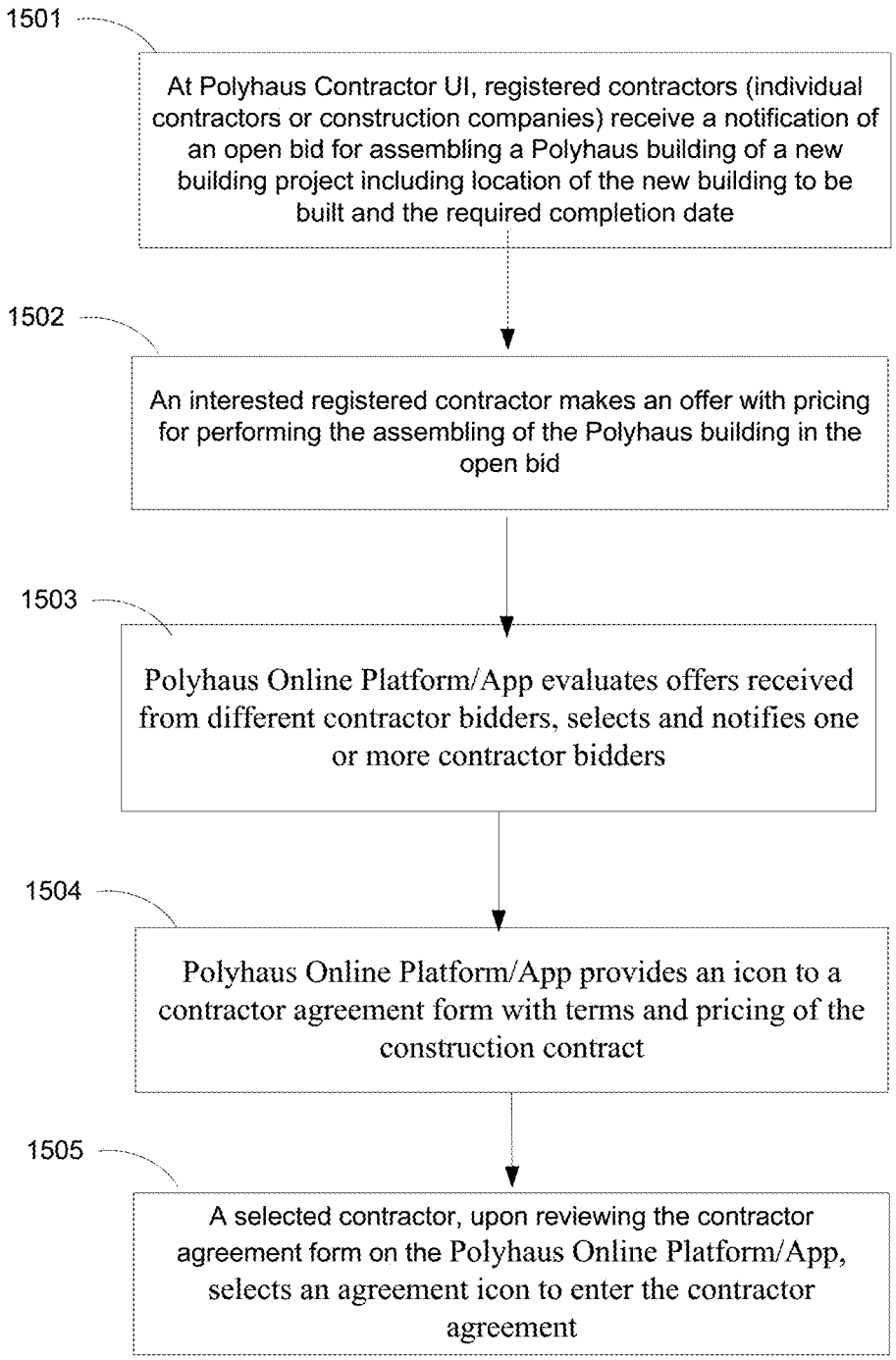

FIG. 15 shows an example of a process flow for operations of the contractor interfacing module 1118. In this example, the contractor interfacing module 1118 provides a contractor interface to enable contractors to register as registered contractors for assembling customized homes or office buildings using composite wood panels that include different wood pieces that are laminated together and are shaped as polygonal facets formed by truncating solid three-dimensional polyhedrons. The registered contractors are certified for technical requirements for assembling buildings based on the composite wood panels and the certification may be provided by taking certain tests for knowledge and skills for assembling buildings based on pre-fabricated and standardized construction building panels in polygonal shapes of varying geometries and sizes. The contractor interfacing module 1118 provides to the registered contractors, using the contractor interface, an invitation to bid for performing construction of one or more listed building projects with information on a location of each construction and completion time of each construction; enables a registered contractor, using the contractor interface, to enter a bid for construction of each listed building project; informs registered contractors, via the contractor interface, a status of the invitation to bid for construction of the one or more listed building projects; and notifies one or more selected registered contractors of acceptance of their bids for construction of a listed building project. In addition, the contractor interfacing module 1118 is operable to allow a selected registered contractor, via the contractor interface, to enter a construction contract for construction of a listed building project.

Based on the above examples for implementing the disclosed technology, a framework is created to provide high quality and customizable designs and construction to integrate different stages of planning and execution in building design, construction and marketing activities. The use of pre-fabricated materials such as Cross Laminated Timber panels to provide the main structural elements, in the form of facets to construct a mathematical pattern derived from truncation, where the faces of polyhedral solids (Tetrahedron, Octahedron, and a Cube) result in a regular network of facets (substantially uniform). The benefits of this regular framework for enclosing space, its articulation with CLT, and its optimized design process through a web-based digital platform of design and visualization lies in an optimized process of design and site placement, in the regular and incremental dimension of the prototypes (truncated tetrahedron, octahedron and cube); responding to zoning and site constraints in an effective manner given the flexibility of the prototypes. The disclosed technology provides substantial flexibility between form and site, zoning constraints to provide a potential of an optimized response to zoning constraints through a web-based app in determining zoning, FAR and set back constraints (and other pertinent zoning overlays) and responding to them through a wide variety of gradually designed prototype variations in plan and volumetrically optimal design and visualization interface for the general public, informed by real-time updated zoning data.

This disclosed technology provides synergy between form and material as both are center on a surface based logic, rather than linearly as it is the case in conventional stud construction made of linear members such as columns and beams and enables optimization of materials and material waste, as it compares to conventional stud construction which has a high degree of material waste. The disclosed technology also enables an optimized process of assembly, in contract to conventional stud-frame construction, where all the regular pieces that constitute the structural core are delivered into site and quickly assembled, and provides efficiency in time and labor in manufacture, delivery and assembly. Some implementations may use an all dry construction process and thus eliminate the time and weather related delays of wet systems of construction like the use of concrete or plaster sheathing.

The online system provides significant reduction of construction crews and trades involved and the process of certification of unskilled construction crews for assembly and the low degree of specialization in the delivery, assembly and construction of the structure collectively improve the quality and cost structure for building construction, especially for customized buildings.

Additional advantages of the disclosed technology includes optimized alignment with off the shelf glazing, insulation, and roofing systems-systems whose alignment to the CLT sheets can be pre-programmed and drilled into the parts before delivery robotically; an optimized structural performance in the overall rigidity of the structure, where floor, walls and roof work in complementarity to produce a regular distribution of structure whose rigidity also reduces foundations; optimization of dry foundations in earth-screws; flexibility in custom openings given the overall rigidity of the form; minimized required material inherent in floors, walls and roof acting structurally; an optimized carbon footprint in the environmental advantage of using CLT grounded on a more sustainable growth of wood, versus other more toxic and higher carbon footprint materials commonly used in the building industry (This is incremented by the possibility of recycling the structure, given that its assembly is in effect a kit of parts open for disassembly); a unique interior and exterior spatial condition in having the wood texture of the CLT shape the interior walls of the space; minimized use of additional interior wall finishes such as dry-wall and plaster for the interior of the overall volume; and optimized flexibility in its exterior appearance due to the flexibility in accommodating off the shelf existing roofing systems.

Implementations of the subject matter and the functional operations described in this patent document can be implemented in various systems, digital electronic circuitry, or in computer software, firmware, or hardware, including the structures disclosed in this specification and their structural equivalents, or in combinations of one or more of them. Implementations of the subject matter described in this specification can be implemented as one or more computer program products, e.g., one or more modules of computer program instructions encoded on a tangible and non-transitory computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing unit" or "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, machine-readable script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of nonvolatile memory, media and memory devices, including by way of example semiconductor memory devices, e.g., EPROM, EEPROM, and flash memory devices. The processor and the memory can be supplemented by, or incorporated in, special purpose logic circuitry.

The following sections list 50 examples of implementations of the disclosed technology.

Item 1. A building structure for providing a sheltered space or an enclosed indoor space suitable for use as business space or dwelling space, comprising:

- a foundation frame formed by rigid bars that are connected to one another;
- a plurality of ground screws engaged to the foundation frame to fix and hold the foundation frame to the ground, each ground screw including a rigid screw body affixed to the foundation frame and a threaded tapered head to allow the ground screw to be rotated to penetrate into the ground for fixing and holding the foundation frame to the ground;
- one or more floor structures formed by pre-fabricated floor panels to engage to the foundation frame to form a floor of the building structure;
- wall structures formed by pre-fabricated wall panels and supported by the foundation frame to form exterior and interior walls of the building structure; and
- a roof formed by pre-fabricated roof panels and positioned above at least part of the wall structures.

Item 2. The building structure as in Item 1, wherein the foundation frame and the ground screws are structured for fixing and holding the foundation frame to the ground without a reinforced concrete foundation.

Item 3. The building structure as in Item 1, wherein the floor panels, the wall panels or the roof panels include polyhedral panels shaped in polygon facets of a truncated three-dimensional polyhedron.

Item 4. The building structure as in Item 3, wherein the truncated three-dimensional polyhedron is a solid tetrahedron.

Item 5. The building structure as in Item 3, wherein the truncated three-dimensional polyhedron is an octahedron.

Item 6. The building structure as in Item 3, wherein the truncated three-dimensional polyhedron is a cube.

Item 7. The building structure as in Item 3, wherein the floor panels, the wall panels or the roof panels include polyhedral panels in different geometries or shapes.

Item 8. The building structure as in Item 3, wherein the floor panels, the wall panels or the roof panels include a composite wood structure that includes different wood pieces that are laminated together.

Item 9. The building structure as in Item 8, wherein the different wood pieces that are laminated together in the composite wood structure in different directions to form a cross laminated timber composite material.

Item 10. A building structure for providing a sheltered space or an enclosed indoor space suitable for use as business space or dwelling space, comprising:

- a foundation frame structured to engage to the ground to support the building structure;
- pre-fabricated floor panels connected to one another and to engage to the foundation frame to form a floor of the building structure;
- pre-fabricated wall panels supported by the foundation frame over the floor to form wall structures of the building structure; and
- pre-fabricated roof panels connected to one another to form a roof structure that is positioned above at least part of the wall structures,
- wherein the floor panels, the wall panels or the roof panels include polyhedral panels shaped in polygon facets of a truncated three-dimensional polyhedron and are made from a pre-manufactured material.

Item 11. The building structure as in Item 10, wherein the truncated three-dimensional polyhedron is a solid tetrahedron.

Item 12. The building structure as in Item 10, wherein the truncated three-dimensional polyhedron is an octahedron.

Item 13. The building structure as in Item 10, wherein the truncated three-dimensional polyhedron is a cube.

Item 14. The building structure as in Item 10, wherein the floor panels, the wall panels or the roof panels include polyhedral panels in different geometries or shapes.

Item 15. The building structure as in Item 10, wherein the floor panels, the wall panels or the roof panels include polyhedral panels from facets of different truncated solid structures in different geometries to achieve different building structural features and appearances.

Item 16. The building structure as in Item 15, wherein the different truncated solid structures in different geometries include solid tetrahedrons, solid octahedrons, or solid cubes.

Item 17. The building structure as in Item 10, wherein the floor panels, the wall panels or the roof panels include a composite wood structure that includes different wood pieces that are laminated together.

Item 18. The building structure as in Item 17, wherein the different wood pieces that are laminated together in the composite wood structure in different directions to form a cross laminated timber composite material.

Item 19. The building structure as in Item 10, wherein the floor panels, the wall panels or the roof panels are structured to include internal connection slots or splines in one or more polygon facets structured to provide an engagement between two panels via (1) one or more connectors inserted into the internal connection slots or splines and (2) screws or nails that are fixed into the two panels and penetrate through the one or more connectors.

Item 20. The building structure as in Item 10, wherein the floor panels, the wall panels or the roof panels are structured to include surface connection slots or splines in one or more polygon facets to provide an engagement between two panels via (1) one or more connectors inserted into the surface connection slots or splines and (2) screws or nails that are fixed into the two panels and penetrate through the one or more connectors.

Item 21. The building structure as in Item 10, wherein the floor panels, the wall panels or the roof panels are structured to include one or more half-lapped joints on one or more polygon facets to enable two panels to connect with each other via fitting half-lapped joints of two connecting polygon facets and having screws or nails fixed into the two connected panels and penetrate through the half-lapped joints of two connecting polygon facets.

Item 22. The building structure as in Item 10, wherein the floor panels, the wall panels or the roof panels are structured to include a connection mechanism engaged to two panels to connect the two panels to each other.

Item 23. The building structure as in Item 22 wherein the connection mechanism includes a metal tube and rods.

Item 24. The building structure as in Item 22, wherein the connection mechanism includes self-tapping screws that are fixed into two panels, respectively, to provide a connection between the two panels.

Item 25. The building structure as in Item 22, wherein the connection mechanism includes one or more brackets that are fixed into two adjacent and contacting polyhedral solid wall units as part of the two connected wall structures, respectively.

Item 26. The building structure as in Item 10, wherein the floor panels, the wall panels or the roof panels are structured to include one or more wood keys and one or more corresponding wood slots for receiving the wood keys to provide engagement between panels.

Item 27. The building structure as in Item 10, comprising a connection between a wall panel and a roof panel that is formed by screws or nails fixing into wall panel and the roof panel.

Item 28. The building structure as in Item 10, comprising a connection between a polyhedral solid wall unit and a polyhedral solid roof unit that is formed by one or more brackets fixed to the polyhedral solid wall unit and the polyhedral solid roof unit.

Item 29. The building structure as in Item 10, comprising a connection between a wall panel and the foundation frame that is formed by one or more brackets fixed to the wall panel and the foundation frame.

Item 30. The building structure as in Item 29, wherein the connection between the wall panel and the foundation frame further includes a wooden profile that fits into a receiving slot in the wall and that is fixed to the foundation frame to provide additional engagement between the wall panel and the foundation frame to enhance engagement provided by the one or more brackets.

Item 31. The building structure as in Item 10, comprising:

one or more insulation layers formed on an exterior of a wall panel; and an exterior trim formed over and covering the one or more insulation layers.

Item 32. A construction building panel for connecting with other construction building panels to form part of a floor, a wall, a roof, or a panel of a building structure as a sheltered space or an enclosed indoor space suitable for use as business space or dwelling space, comprising:

a panel body that includes different wood pieces that are laminated together and is shaped as a polygonal facet formed by truncating a solid three-dimensional polyhedron which includes a solid tetrahedron, solid octahedron, or solid cube; and a connection mechanism formed on a side of the panel body and structured to connect with a corresponding connection mechanism on another construction building panel.

Item 33. The construction building panel as in Item 32, wherein the connection mechanism includes:

one or more internal connection slots or splines structured to enable each internal connection slot or spline to receive a connector to connect with an internal connection slot or spline of another construction building panel to connect to each other and to receive one or more screws or nails that are fixed into the two connected construction building panels and penetrate through the connector.

Item 34. The construction building panel as in Item 32, wherein the connection mechanism includes:

one or more surface connection slots or splines structured so that each surface connection slot or spline is capable of receiving a connector to connect with a surface connection slot or spline of another construction building panel to connect to each other and to receive one or more screws or nails that are fixed into the two connected construction building panels and penetrate through the connector.

Item 35. The construction building panel as in Item 32, wherein the connection mechanism includes:

a half-lapped joint on a polygon facet to fit to a half-lapped joint of another construction building panel to connect to each other and to receive screws or nails that are fixed into the two connected construction building panels and penetrate through the half-lapped joints.

Item 36. The construction building panel as in Item 32, wherein the connection mechanism includes:

one or more keys or protrusions formed one side of a construction building panel and one or more slots formed in a side of another construction building panel so that a key or protrusion of one panel can fit into a slot of another panel to connect the two construction building panels together.

Item 37. The construction building panel as in Item 32, wherein the connection mechanism includes an edge hinge structure that is formed on an edge of the panel body and includes a first flat part fixed to the panel body, a second flat part not affixed to the panel body, and a hinge to engage the first and second flat parts to each other to allow the second flat part to rotate with respect to the first flat part affixed to the panel body to connect to another construction building panel in a way similar to a piano hinge connector for a piano cover.

Item 38. A method for assembling pre-fabricated components to form a building structure as a sheltered space or an enclosed indoor space suitable for use as business space or dwelling space, comprising:

providing pre-fabricated construction building panels of varying shapes and sizes for forming floor, wall and roof structures of the building structure, each construction building panel structured to include a composite wood panel that includes different wood pieces that are laminated together and is shaped as a polygonal facet formed by truncating a solid three-dimensional polyhedron;

assembling a first group of the pre-fabricated construction building panels designed for a floor of the building structure together to engage to a foundation at a site of the building structure to form the floor;

assembling a second group of the pre-fabricated construction building panels designed for walls of the building structure to engage to the floor or the foundation; and assembling a third group of the pre-fabricated construction building panels designed for a roof of the building structure to form the roof over at least part of the walls.

Item 39. The method as in Item 38, comprising:

anchoring the foundation to the ground using a dry method of construction without using wet concrete on site.

Item 40. The method as in Item 39, comprising:

the dry method of construction includes assembling a foundation frame by using pre-fabricated components and anchoring the foundation frame to the ground by using ground screws that are driven into the ground to engage, fix and support the foundation frame.

Item 41. A method for using an Internet-based software application for assembling customized homes or office buildings based on pre-fabricated and standardized construction building panels of varying shapes and sizes, each construction building panel structured to include a composite wood panel that includes different wood pieces that are laminated together and is shaped as a polygonal facet formed by truncating a solid three-dimensional polyhedron, the method comprising:

providing a customer interface to enable a customer to provide information on a customer building to be constructed, including information on a location of the customer building;

presenting to the customer, using the customer interface, relevant zoning information based on local zoning regulations, the relevant zoning information including a parcel number and lot size of the location of the customer building, occupancy classification, Zone information, allowable height and set-backs, building Data, floor-to-area (F.A.R) calculations;

providing to the customer, using the customer interface, design options for the customer building for a customized design having structures and components that can be formed by using pre-fabricated and standardized construction building panels in response to building requirements from the customer, wherein the design options include pre-approved design plans in compliance with the local zoning regulations and applicable building codes according to available geometries for the construction building panels based on truncated solid three-dimensional polyhedrons including: truncated tetrahedrons, truncated octahedrons, truncated cubes and/or other polyhedral shapes;

providing to the customer, using the customer interface, estimated cost and building construction schedule for each of the design options to facilitate the customer to select one of the design options;

enabling the customer, using the customer interface, to select one of the design options and approve a purchase contract for a customer selected design option; and providing to the customer, using the customer interface, a notification for beginning of the performance of the purchase contract for the customer selected design option and updates on progress and remaining schedule in construction of the customer building under the customer selected design option.

Item 42. The method as in Item 41, wherein each of the pre-approved design plans in compliance with the local zoning regulations and applicable building codes includes base drawings that include: 1. Site Plan, 2. Roof Plan, 3. Elevations, 4. Detailed Plans and Sections, and 5. Interior and Exterior Renderings.

Item 43. The method as in Item 41, comprising:

enabling the customer, via the customer interface, to access virtual rendition of each of the design options as part of a customer design and selection process.

Item 44. The method as in Item 41, comprising:

enabling the customer, via the customer interface, to access virtual rendition of the customer building under construction, including images of the actual customer building under construction.

Item 45. A method for using an Internet-based software application for ordering building materials from suppliers for assembling customized homes or office buildings based on pre-fabricated and standardized construction building panels of varying shapes and sizes, each construction building panel structured to include a composite wood panel that includes different wood pieces that are laminated together and is shaped as a polygonal facet formed by truncating a solid three-dimensional polyhedron, the method comprising:

providing a supplier interface to enable suppliers to register as registered suppliers for bidding supply of building materials for assembling customized homes or office buildings;

providing to the registered suppliers, using the supplier interface, an invitation to bid for supplying a list of building materials and pre-fabricated components including construction building panels shaped in polygonal facets from truncated solid three-dimensional polyhedrons for a customized design;

enabling a registered supplier, using the supplier interface, to enter a bid for the listed building materials and pre-fabricated components;

informing registered suppliers, via the supplier interface, a status of the invitation to bid for supplying the listed building materials and pre-fabricated components;

notifying one or more selected registered suppliers of acceptance of their bids for supplying the listed building materials and pre-fabricated components; and enabling a selected registered supplier, via the supplier interface, to enter a purchase contract for supplying a part of or an entirety of the listed building materials and pre-fabricated components.

Item 46. The method as in Item 45, comprising:

enabling a selected registered supplier, via the supplier interface, to provide a status update on delivering the listed building materials and pre-fabricated components to a site for a customized home or office building.

Item 47. A method for using an Internet-based software application for contracting construction contractors for assembling customized homes or office buildings based on pre-fabricated and standardized construction building panels of varying shapes and sizes, each construction building panel structured to include a composite wood panel that includes different wood pieces that are laminated together and is shaped as a polygonal facet formed by truncating a solid three-dimensional polyhedron, the method comprising:

providing a contractor interface to enable contractors to register as registered contractors for assembling customized homes or office buildings using composite wood panels that include different wood pieces that are laminated together and are shaped as polygonal facets formed by truncating solid three-dimensional polyhedrons, wherein the registered contractors are certified for technical requirements for assembling buildings based on the composite wood panels;

providing to the registered contractors, using the contractor interface, an invitation to bid for performing construction of one or more listed building projects with information on a location of each construction and completion time of each construction;

enabling a registered contractor, using the contractor interface, to enter a bid for construction of each listed building project;

informing registered contractors, via the contractor interface, a status of the invitation to bid for construction of the one or more listed building projects;

notifying one or more selected registered contractors of acceptance of their bids for construction of a listed building project; and enabling a selected registered contractor, via the contractor interface, to enter a construction contract for construction of a listed building project.

Item 48. A system for using an Internet-based software application to provide services for assembling customized homes or office buildings based on pre-fabricated and standardized construction building panels of varying shapes and sizes, each construction building panel structured to include a composite wood panel that includes different wood pieces that are laminated together and is shaped as a polygonal facet formed by truncating a solid three-dimensional polyhedron, the method comprising:

a customer interfacing module configured to be operable to provide a customer interface to enable a customer to provide information on a customer building to be constructed, to provide design options, building costs and building schedules for the customer building in compliance with local zoning regulations and building codes and to complete a purchase of a customer selected design for the customer building;

a supplier interfacing module in communication with the customer interfacing module and operable to receive information of building materials and construction schedule for the customer selected design for the customer building based on pre-fabricated and standardized construction building panels of varying shapes and sizes, the supplier interfacing module operable to interact with registered suppliers, via a supplier interface, to solicit bidding from the registered suppliers and to select bid offers to order the building materials from one or more selected registered suppliers for delivery to a location of the customer building based on the construction schedule for the customer selected design for the customer building; and a contractor interfacing module in communication with the customer interfacing module and operable to receive information of the construction of the customer building under the customer selected design, the contractor interfacing module operable to interact with registered contractors with certification to perform construction using pre-fabricated and standardized construction building panels, to solicit, via a contractor interface, bidding from the registered contractors and to select bid offers for assembling the customer building based on the construction location and construction schedule, wherein the customer interfacing module, the supplier interfacing module and the contractor interfacing module collaborate to perform operations for completing construction of the customer building based on the customer selected design.

Item 49. The system as in Item 48, comprising databases to store information on local zoning regulations and building codes in different geographical areas where the services for assembling customized homes or office buildings are provided and search engines to monitor and update stored information on local zoning regulations and building codes.

Item 50. The system as in Item 48, comprising a control engine in communication with the customer interfacing module, the supplier interfacing module and the contractor interfacing module to coordinate and to control operations of the customer interfacing module, the supplier interfacing module and the contractor interfacing module for completing construction of the customer building based on the customer selected design.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A building structure for providing a sheltered space or an enclosed indoor space suitable for use as business space or dwelling space, comprising:

a foundation frame formed by rigid bars that are connected to one another;

a plurality of ground screws engaged to the foundation frame to fix and hold the foundation frame to the ground, each ground screw including a rigid screw body affixed to the foundation frame and a threaded tapered head to allow the ground screw to be rotated to penetrate into the ground for fixing and holding the foundation frame to the ground;

one or more floor structures formed by pre-fabricated floor panels to engage to the foundation frame to form a floor of the building structure;

wall structures formed by pre-fabricated wall panels and supported by the foundation frame to form exterior and interior walls of the building structure; and a roof formed by pre-fabricated roof panels and positioned above at least part of the wall structures, wherein the floor panels, the wall panels, or the roof panels are structured to include a connection mechanism engaged to two panels to connect the two panels to each other, the connection mechanism including one or more screws or nails that are fixed into the two panels, respectively, to provide a connection between the two panels, wherein the floor panels, the wall panels and the roof panels include polyhedral panels shaped in polygon facets of a truncated three-dimensional polyhedron, wherein the polyhedral panels for the floor panels, the wall panels and the roof panels shaped in polygon facets of the truncated three-dimensional polyhedron are portions of an original three-dimensional polyhedron located outside a set of symmetrically placed faces of the original three-dimensional polyhedron.

2. The building structure as in claim 1, wherein the foundation frame and the ground screws are structured for fixing and holding the foundation frame to the ground without a reinforced concrete foundation.

3. The building structure as in claim 1, wherein the polygon facets for the floor panels, the wall panels and the roof panels are polyhedral panels that are located at points along edges of the original three-dimensional polyhedron by a ratio r not greater than ½, where r is a fraction of an edge length at which to truncate.

4. The building structure as in claim 3, wherein the floor panels, the wall panels or the roof panels include polyhedral panels in different geometries or shapes.

5. The building structure as in claim 3, wherein the floor panels, the wall panels or the roof panels include a composite wood structure that includes different wood pieces that are laminated together in different directions to form a cross laminated timber composite material.

6. A building structure for providing a sheltered space or an enclosed indoor space suitable for use as business space or dwelling space, comprising:

a foundation frame structured to engage to the ground to support the building structure;

pre-fabricated floor panels connected to one another and to engage to the foundation frame to form a floor of the building structure;

pre-fabricated wall panels supported by the foundation frame over the floor to form wall structures of the building structure; and pre-fabricated roof panels connected to one another to form a roof structure that is positioned above at least part of the wall structures, wherein the floor panels, the wall panels, or the roof panels are structured to include a connection mechanism engaged to two panels to connect the two panels to each other, the connection mechanism including one or more screws or nails that are fixed into the two panels, respectively, to provide a connection between the two panels, wherein the floor panels, the wall panels or the roof panels include polyhedral panels shaped in polygon facets of a truncated three-dimensional polyhedron and are made from a pre-manufactured material, wherein the polygon facets of the floor panels, the wall panels, and the roof panels are connected to one another to form a floor, wall, and roof structure of the building structure to take on a geometry or shape of the truncated three-dimensional polyhedron.

7. The building structure as in claim 6, wherein the floor panels, the wall panels or the roof panels include polyhedral panels in different geometries or shapes.

8. The building structure as in claim 6, wherein the floor panels, the wall panels or the roof panels include polyhedral panels from facets of different truncated solid structures in different geometries to achieve different building structural features and appearances.

9. The building structure as in claim 8, wherein the different truncated solid structures in different geometries include solid tetrahedrons, solid octahedrons, or solid cubes.

10. The building structure as in claim 8, wherein the floor panels, the wall panels or the roof panels include a composite wood structure that includes different wood pieces that are laminated together in different directions to form a cross laminated timber composite material.

11. The building structure as in claim 8, wherein the floor panels, the wall panels or the roof panels are structured to include internal connection slots or splines in one or more polygon facets structured to provide an engagement between two panels via (1) one or more connectors inserted into the internal connection slots or splines and (2) screws or nails that are fixed into the two panels and penetrate through the one or more connectors.

12. The building structure as in claim 6, wherein the floor panels, the wall panels or the roof panels are structured to include surface connection slots or splines in one or more polygon facets to provide an engagement between two panels via (1) one or more connectors inserted into the surface connection slots or splines and (2) screws or nails that are fixed into the two panels and penetrate through the one or more connectors.

13. The building structure as in claim 6, wherein the floor panels, the wall panels or the roof panels are structured to include one or more half-lapped joints on one or more polygon facets to enable two panels to connect with each other via fitting half-lapped joints of two connecting polygon facets and having screws or nails fixed into the two connected panels and penetrate through the half-lapped joints of two connecting polygon facets.

14. The building structure as in claim 6, wherein the floor panels, the wall panels or the roof panels are structured to include one or more wood keys and one or more corresponding wood slots for receiving the wood keys to provide engagement between panels.

15. The building structure as in claim 6, comprising a connection between a polyhedral solid wall unit and a polyhedral solid roof unit that is formed by one or more brackets fixed to the polyhedral solid wall unit and the polyhedral solid roof unit.

16. The building structure as in claim 6, comprising a connection between a wall panel and the foundation frame that is formed by one or more brackets fixed to the wall panel and the foundation frame.

17. The building structure as in claim 16, wherein the connection between the wall panel and the foundation frame further includes a wooden profile that fits into a receiving slot in the wall and that is fixed to the foundation frame to provide additional engagement between the wall panel and the foundation frame to enhance engagement provided by the one or more brackets.

18. A construction building panel for connecting with other construction building panels to form part of a floor, a wall, a roof, and a panel of a building structure as a sheltered space or an enclosed indoor space suitable for use as business space or dwelling space, comprising:

a panel body that includes different wood pieces that are laminated together and is shaped as a polygonal facet formed by truncating a solid three-dimensional polyhedron which includes a solid tetrahedron, solid octahedron, or solid cube, wherein the polygonal facet is located outside a set of symmetrically placed faces of the solid three-dimensional polyhedron and is located at points along edges of the solid three-dimensional polyhedron by a ratio r not greater than ½, where r is a fraction of an edge length at which to truncate; and a connection mechanism formed on a side of the panel body and structured to connect with a corresponding connection mechanism on another construction building panel, wherein the connection mechanism includes one or more screws or nails that are fixed into the construction building panel and the another construction building panel, respectively, to provide a connection therebetween.

19. The construction building panel as in claim 18, wherein the connection mechanism includes:

one or more internal connection slots or splines structured to enable each internal connection slot or spline to receive a connector to connect with an internal connection slot or spline of another construction building panel to connect to each other and to receive one or more screws or nails that are fixed into the two connected construction building panels and penetrate through the connector.

20. The construction building panel as in claim 18, wherein the connection mechanism includes:

one or more surface connection slots or splines structured so that each surface connection slot or spline is capable of receiving a connector to connect with a surface connection slot or spline of another construction building panel to connect to each other and to receive one or more screws or nails that are fixed into the two connected construction building panels and penetrate through the connector.

21. The construction building panel as in claim 18, wherein the connection mechanism includes:

a half-lapped joint on a polygon facet to fit to a half-lapped joint of another construction building panel to connect to each other and to receive screws or nails that are fixed into the two connected construction building panels and penetrate through the half-lapped joints.

22. The construction building panel as in claim 18, wherein the connection mechanism includes:

one or more keys or protrusions formed one side of a construction building panel and one or more slots formed in a side of another construction building panel so that a key or protrusion of one panel can fit into a slot of another panel to connect the two construction building panels together.

23. The construction building panel as in claim 18, wherein the connection mechanism includes an edge hinge structure that is formed on an edge of the panel body and includes a first flat part fixed to the panel body, a second flat part not affixed to the panel body, and a hinge to engage the first and second flat parts to each other to allow the second flat part to rotate with respect to the first flat part affixed to the panel body to connect to another construction building panel in a way similar to a piano hinge connector for a piano cover.

24. The building structure as in claim 1, further comprising an engagement mechanism to engage the floor panels, the wall panels or the roof panels to one another as part of the building structure, wherein the engagement mechanism includes hinged connection joints formed on exterior edges of each of the respective polygon facets.

* * * * *